US007785082B2

(12) United States Patent
Mitsuda et al.

(10) Patent No.: US 7,785,082 B2
(45) Date of Patent: Aug. 31, 2010

(54) SEALLESS PUMP

(75) Inventors: Kimihiko Mitsuda, Hyogo-ken (JP); Yasuharu Yamamoto, Hyogo-ken (JP); Toshiyuki Osada, Hyogo-ken (JP); Zenichi Yoshida, Hyogo-ken (JP)

(73) Assignee: Mitsubishi Heavy Industries, Ltd, Tokyo (JP)

( * ) Notice: Subject to any disclaimer, the term of this patent is extended or adjusted under 35 U.S.C. 154(b) by 594 days.

(21) Appl. No.: 11/221,989

(22) Filed: Sep. 9, 2005

(65) Prior Publication Data

US 2006/0057003 A1 Mar. 16, 2006

(30) Foreign Application Priority Data

Sep. 15, 2004 (JP) ..... 2004-267967

(51) Int. Cl.
*F01D 3/02* (2006.01)
*F04D 25/06* (2006.01)
*F04D 29/041* (2006.01)
*F04D 29/047* (2006.01)

(52) U.S. Cl. ..... 417/423.5; 417/350; 417/365; 417/423.12; 417/423.13; 415/104

(58) Field of Classification Search ..... 415/106, 415/104; 417/365, 424.2
See application file for complete search history.

(56) References Cited

U.S. PATENT DOCUMENTS 3,150,820 A * 9/1964 Jekat et al. ..... 415/201
3,228,734 A * 1/1966 Bizzigotti ..... 384/111
3,589,827 A * 6/1971 Gerasimenko et al. ..... 415/106
4,365,849 A * 12/1982 Halloran ..... 384/398
5,884,498 A * 3/1999 Kishimoto et al. ..... 62/228.1
6,193,473 B1 * 2/2001 Mruk et al. ..... 417/350
6,260,367 B1 * 7/2001 Furuya et al. ..... 62/197

FOREIGN PATENT DOCUMENTS

| | | |
|---|---|---|
| EP | 0 121 053 B1 | 5/1987 |
| JP | 52-64001 | 5/1977 |
| JP | 59-108897 | 6/1984 |
| JP | 59-160093 | 9/1984 |
| JP | 60-017293 | 1/1985 |
| JP | 60-18292 | 2/1985 |
| JP | 6-038435 A | 2/1994 |
| JP | 07-259787 | 10/1995 |
| JP | 9-264292 A | 10/1997 |
| JP | 10-024270 | 1/1998 |
| JP | 2000-154795 | 6/2000 |
| JP | 2000-227117 A | 8/2000 |
| JP | 2003-149375 | 5/2003 |

* cited by examiner

*Primary Examiner*—Devon C Kramer
*Assistant Examiner*—Philip Stimpert
(74) *Attorney, Agent, or Firm*—Birch, Stewart, Kolasch & Birch, LLP

(57) ABSTRACT

A rotating shaft is supported by journal bearings that can support without contacting the rotating shaft itself. Then, one end of both shaft end portions of the rotating shaft has a main impeller installed and the other end is provided with a sub impeller. By utilizing a force being generated by rotation of the main impeller, liquid being pumped (fluid being pumped) is sucked in through a suction port and discharged through a discharge port. On the other hand, by utilizing a force being generated by rotation of the sub impeller, fluid is transported to the journal bearings, thereby having the journal bearings support the rotating shaft.

13 Claims, 12 Drawing Sheets

RELATED ART

FIG.12

| HEAT RESISTANCE CLASS | TEMPERATURE (°C) |
|---|---|
| Y | 90 |
| A | 105 |
| E | 120 |
| B | 130 |
| F | 155 |
| H | 180 |
| 200 | 200 |
| 220 | 220 |
| 250 | 250 |

SEALLESS PUMP

The present patent application is based on Patent Application applied as 2004-267967 in Japan on Sep. 15, 2004 and includes the complete contents thereof for reference.

BACKGROUND OF THE INVENTION

1. Field of the Invention

The present invention relates to a sealless pump which does not employ mechanical seals (seal members) but adopts non-contact type bearings for bearings of a motor.

2. Description of the Prior Art

For example, a sealless pump utilizes an impeller being rotated by a motor so as to discharge fluid and the like. Normally, mechanical seals and the like are used in order to separate a pump portion and a motor portion.

However, it is difficult to completely prevent fluid and the like of very low temperature and very high temperature or fluid and the like of very low pressure and very high pressure from leaking, by using mechanical seals. Therefore, a sealless pump employing no mechanical seals has been developed.

As a sealless pump, there is such one as integrates a motor and a pump and is sealed in a container (a can and the like) (for example, a canned motor pump). Because such a sealless pump as mentioned above is completely sealed, fluid and the like of very low temperature and very high temperature or chemicals and the like of strong acid, strong alkali and the like do not absolutely leak.

However, even the bearings of a rotating shaft will be soaked in fluid and the like. Additionally, a bearing member is sometimes worn away and worn particles serve as dusts, which result in contamination of liquid. Therefore, a sealless pump adopting non-contact type bearings has been developed.

For example, a sealless pump 189 in a patent literature 1 (Publication Bulletin of Patent Application Laid Open 9-264292 (Laid-Open Disclosure Date: Oct. 7, 1997) shown in FIG. 11 is such a sealless pump as has a non-contact type magnetic bearing 191 provided to one end of a rotating shaft 122 and has a non-contact type hydrostatic bearing 192 provided to the other end of the rotating shaft 122.

This sealless pump 189 has a magnetic bearing (magnetic bearing equipment), which conventionally has been installed to both ends of the rotating shaft, provided to one end only, thereby achieving size down of an entire sealless pump as well as cost reduction.

And now, in such a sealless pump as described hereinabove, the temperature of liquid being pumped which can be pneumatically transmitted is limited by the predetermined heat resistance insulation temperature of the motor. (See FIG. 12, a partial excerpt from JIS C 4003-198.)

Then, in the sealless pump 189 as described in the patent literature 1, when the temperature of fluid and the like which are pneumatically transmitted becomes high, the heat resistance insulation temperature of the motor (a rotor, a stator and the like) must be enhanced, too. Otherwise, an entrance port 193 must be installed in order to flow fluid for cooling fluid as illustrated.

And then, when fluid and the like of very high temperature and the like are pneumatically transmitted by such a sealless pump 189 as shown in the patent literature 1, cost will be necessary for enhancing the heat resistance insulation temperature of the motor. In other words, a problem will occur which will lead to a rising cost of the sealless pump itself.

Additionally, when an entrance port 193 for cooling is provided and cooling fluid is flowed through the entrance port 193, the cooling fluid will be introduced to a suction port 115 of the sealless pump 189 by way of an inside passageway 194 which is provided to a manifold casing 117 of the pump.

Then, when the cooling fluid is introduced and mixed in, small babbles and dusts and the like (particles and the like) will be generated. In the result, a problem will occur that particles get mixed in the fluid and the like being sent forth from a discharge port 116 of the sealless pump 189.

SUMMARY OF THE INVENTION

The present invention is intended to solve the above-mentioned problems. It is an object of the present invention to provide a sealless pump which can pneumatically transmit fluid at low costs without having particles and the like be introduced and mixed in.

According to the present invention, in order to achieve the above-mentioned object, a sealless pump is constructed in a manner that a manifold unit being provided with a suction port and a discharge port is connected to a motor unit housing a rotating shaft.

Wherein, the above-mentioned rotating shaft is supported by non-contact type bearings which support without contacting the rotating shaft itself as well as has a first impeller installed to one end of shaft end portions of the rotating shaft and has a second impeller installed to the other end thereof.

Then, it is a characteristic of the present invention that by utilizing a force being generated by rotation of the above-mentioned first impeller, fluid being pumped is sucked in through the above-mentioned suction port and discharged through the above-mentioned discharge port, while by utilizing a force being generated by rotation of the above-mentioned second impeller so as to supply the fluid to the above-mentioned non-contact type bearings, the above-mentioned non-contact bearings support the above-mentioned rotating shaft.

In this way, impellers (the first impeller and the second impeller) are provided to both ends of the rotating shaft. Additionally, one impeller (the first impeller) serves for suction and discharge of fluid being pumped, while the other impeller (the second impeller) serves for supporting the rotating shaft.

Then, in order to generate pressures which are to be used for supporting the rotating shaft, a pressure device (a booster pump and the like) which is conventionally provided becomes unnecessary. Therefore, a sealless pump in accordance with the present invention will be a sealless pump which costs low and is downsized (to occupy a little space) because a pressure device is not provided thereto.

To put it plainly, a sealless pump in accordance with the present invention can exercise full functions of bearings without installing a booster pump and the like, for example, but by having the first impeller installed to one end portion of the rotating shaft and having the second impeller installed to the other end so that fluid will be supplied to non-contact type bearings (such as hydrostatic bearings and the like, for example) by utilizing the second impeller.

Additionally, while the first impeller is installed for flowing the fluid being pumped, the second impeller is installed for flowing the fluid for non-contact bearings, and the fluid being pumped and the fluid (the fluid for bearings) do not get mixed with each other. (An independent flow paths is established, respectively.)

As a result, a sealless pump in accordance with the present invention can pneumatically transmit the fluid being pumped at a low cost and, for example, without having particles and the like being generated in the fluid for bearings get mixed in the fluid being pumped.

The above-mentioned object and other objects and characteristics of the present invention will be clarified further with reference to the following description of the preferred embodiments and the attached drawings.

DESCRIPTION OF THE DRAWINGS

FIG. 12 is a table being partially excerpted from JIS C 4003-1998.

DESCRIPTION OF THE PREFERRED EMBODIMENTS

Figure 1:
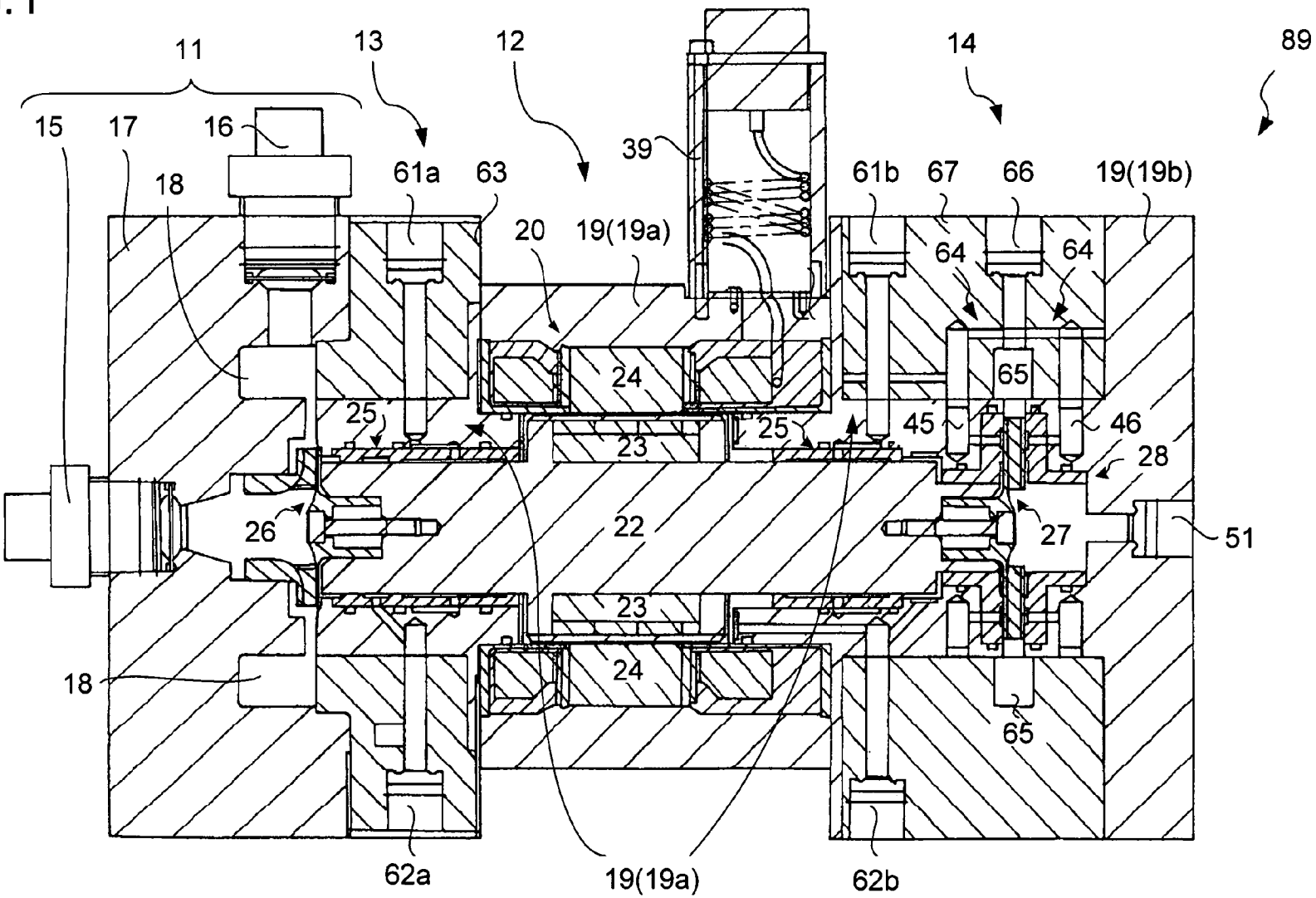
FIG. 1 is a longitudinal cross-sectional view showing the whole sealless pump in accordance with the embodiment of the present invention.

Referring now to the drawings (FIG. 1 through FIG. 10), an embodiment of the present invention will be described as follows.

Figure 2:
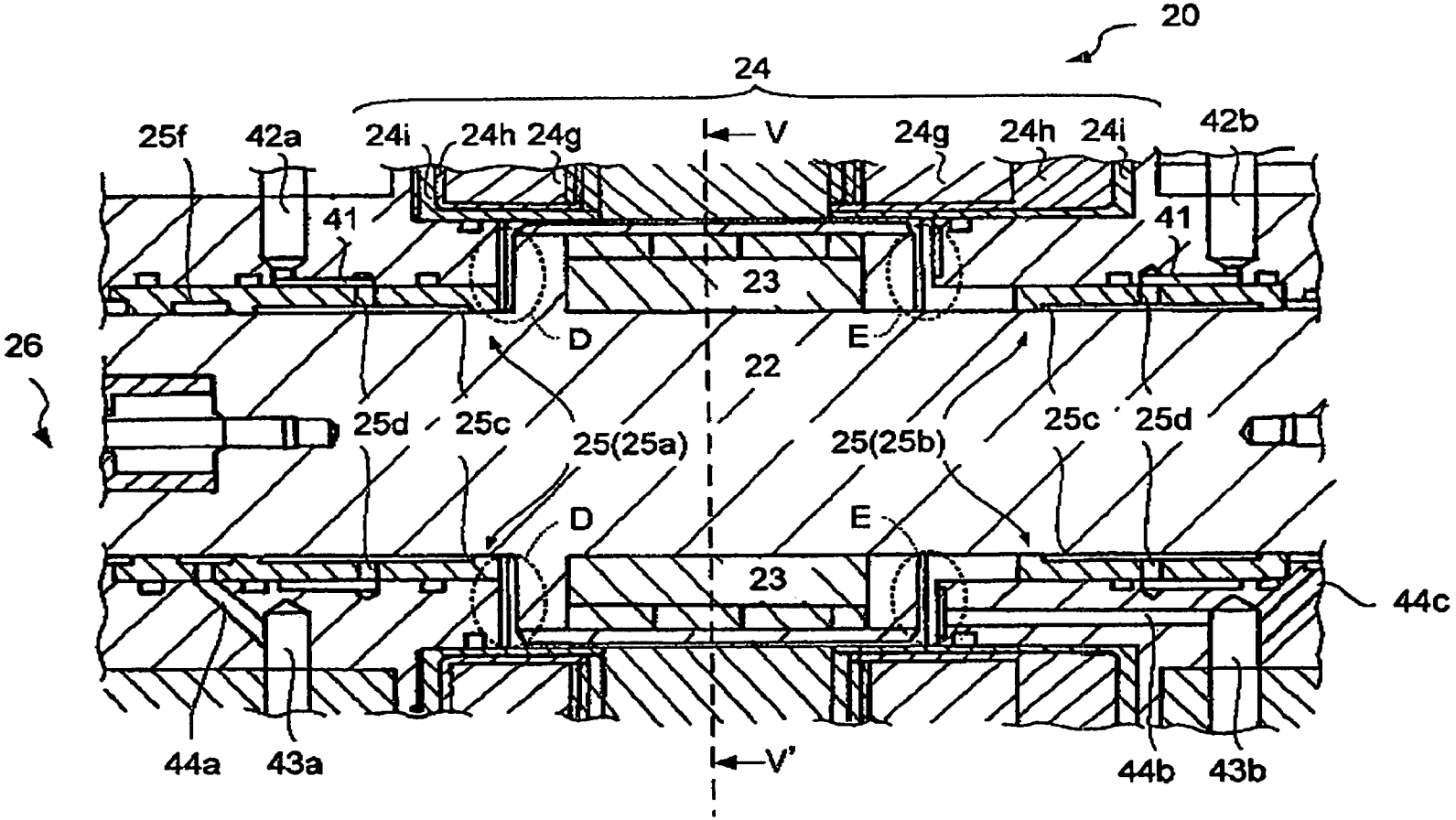
FIG. 2 is a partial cross-sectional view showing the proximity of a motor of the sealless pump in accordance with the embodiment of the present invention.
Figure 3:
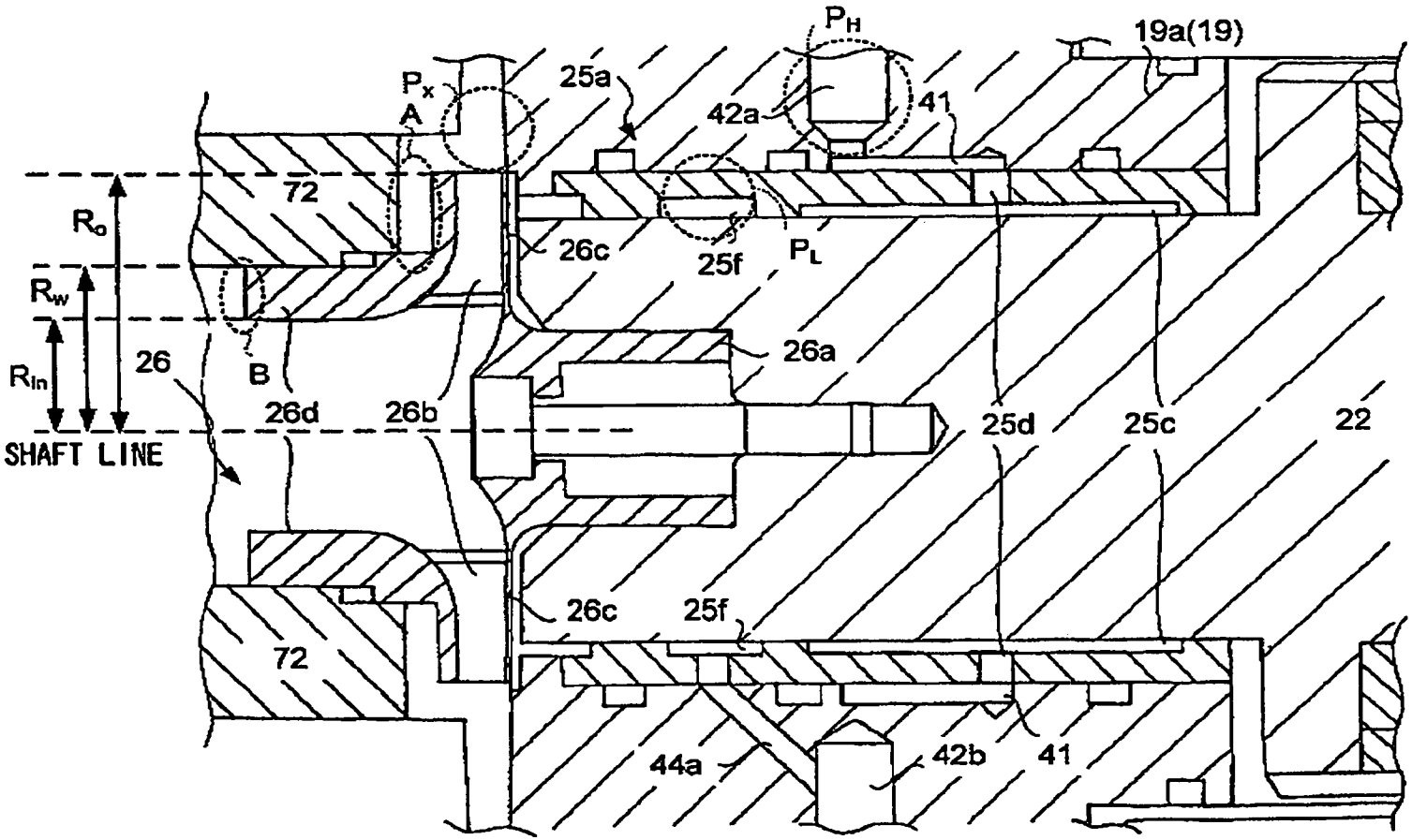
FIG. 3 is a partial cross-sectional view showing the proximity of a main impeller of the sealless pump in accordance with the embodiment of the present invention.
Figure 4:
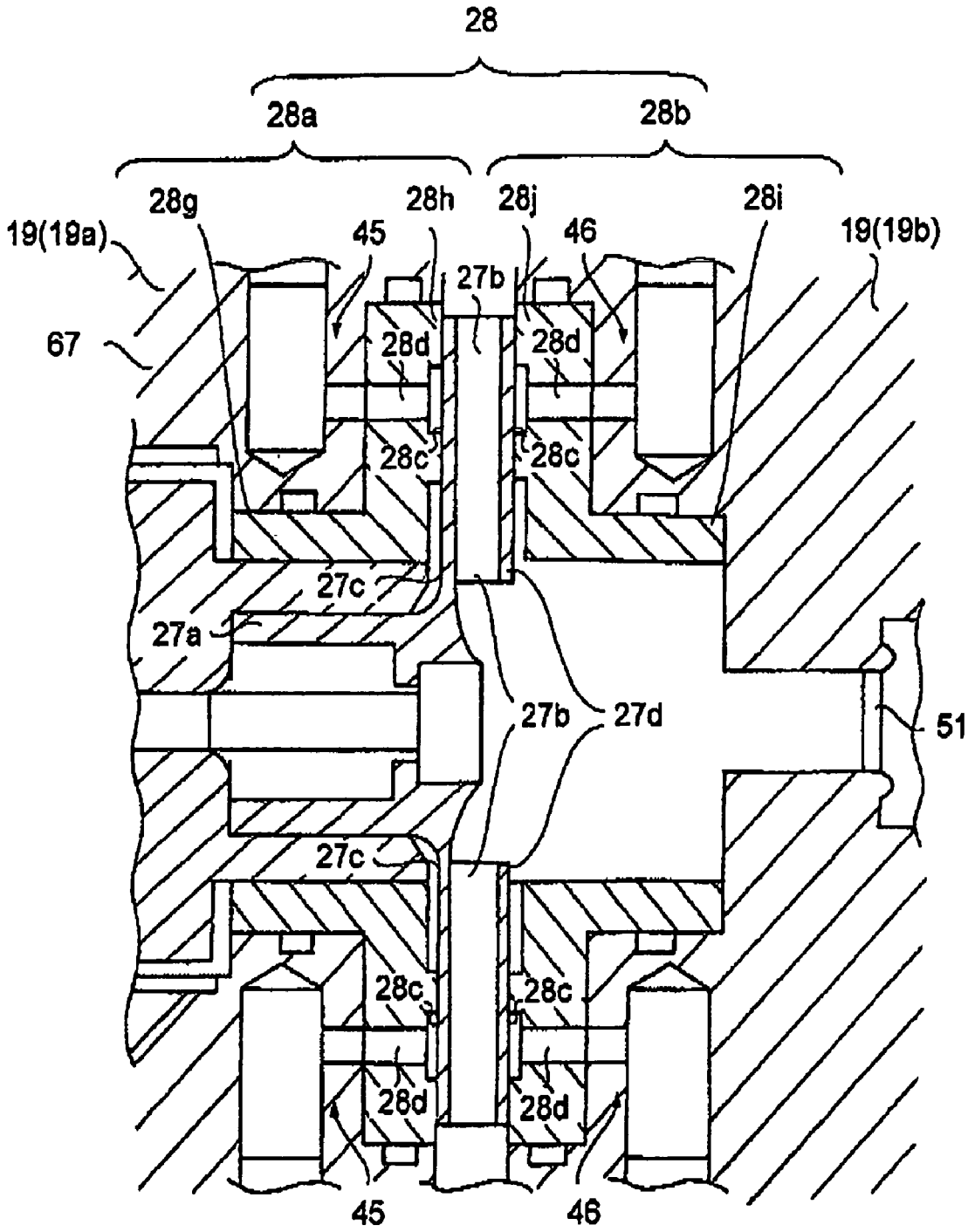
FIG. 4 is a partial cross-sectional view showing the proximity of a sub impeller of the sealless pump in accordance with the embodiment of the present invention.

First, FIG. 1 is a longitudinal cross-sectional view showing the whole of a sealless pump 89 in accordance with the present invention. FIG. 2 is a partial cross-sectional view showing the proximity of a motor 20 of the sealless pump 89. FIG. 3 is a partial cross-sectional view showing the proximity of a main impeller 26. FIG. 4 is a partial cross-sectional view showing the proximity of a sub impeller 27.

In FIG. 1 and the like, as for the number of a member that cannot be written therein due to limitations of space, other partial cross-sectional views and the like must be referred to.

First Embodiment

[Construction of the Sealless Pump]

As shown in FIG. 1, the sealless pump 89 in accordance with an embodiment of the present invention (for example, such a sealless pump as a canned sealless pump and the like) is constructed so as to include a manifold unit 11, a motor unit (a driving unit) 12, a first bearing unit 13 and a second bearing unit 14.

And, these members (the manifold unit 11, the motor unit 12, the first bearing unit 13 and the second bearing unit 14) are mutually connected by using tightening bolts and the like (not being illustrated).

[[Construction of the Manifold Unit]]

The manifold unit 11 is constructed so as to include a suction port 15 where fluid (liquid being pumped) which is to be transmitted out is sucked in, a discharge port 16 where the sucked-in fluid (fluid being pumped) is discharged (ejected) and a manifold casing 17 which houses these suction port 15 and discharge port 16.

In addition, the manifold casing 17 is provided with a flow pathway [a cylindrical collector for circulation (a cylindrical collector for circulation 18)] which connects the suction port 15 and the discharge port 16.

For example, the cylindrical collector for circulation 18 has the axial direction (the shaft end) of a rotating shaft 22 being provided with a main impeller 26 to be described hereafter serve as the center as well as serves as a flow pathway which is formed in a spiral along the axial direction (the shaft line) of the rotating shaft 22.

Additionally, wherein, a pipe connecting to the suction port 15 and the like (a suction pipe which is not illustrated) and a pipe connecting to the discharge port 16 and the like (a discharge pipe which is not illustrated) are connected to a tank of liquid being pumped which is not illustrated.

Moreover, the sealless pump 89 in accordance with the present invention circulates this liquid being pumped (fluid being pumped) by utilizing the rotating force of a motor 20 and the like that will be described hereafter. (Details will be described hereafter.)

[[Construction of the Motor Unit]]

The motor unit 12 is constructed so as to include a motor 20, a casing 19 which houses the motor 20 and a power socket 39 supplying electrical power to the motor 20 (the driving portion).

<Motor>

The motor 20 is constructed so as to include a rotating shaft 22 which is a rotating shaft in the shape of a rod, a rotating means (a rotor) 23, a static means (a stator) 24, journal bearings 25, a main impeller (the first impeller) 26, a sub impeller (the second impeller) 27 and a thrust bearing 28.

<<Rotor>>

The rotor 23 is a cylindrical dielectric material which is installed around the rotating shaft 22 (for example, in the proximity of the center of the rotating shaft 22 in a longitudinal direction). In addition, the rotor 23 is provided with a rotor can (not being illustrated) serving as a thin cylindrical member for preventing deposition so as to cover the outer circumference of the rotor 23.

<<Stator>>

Figure 5:
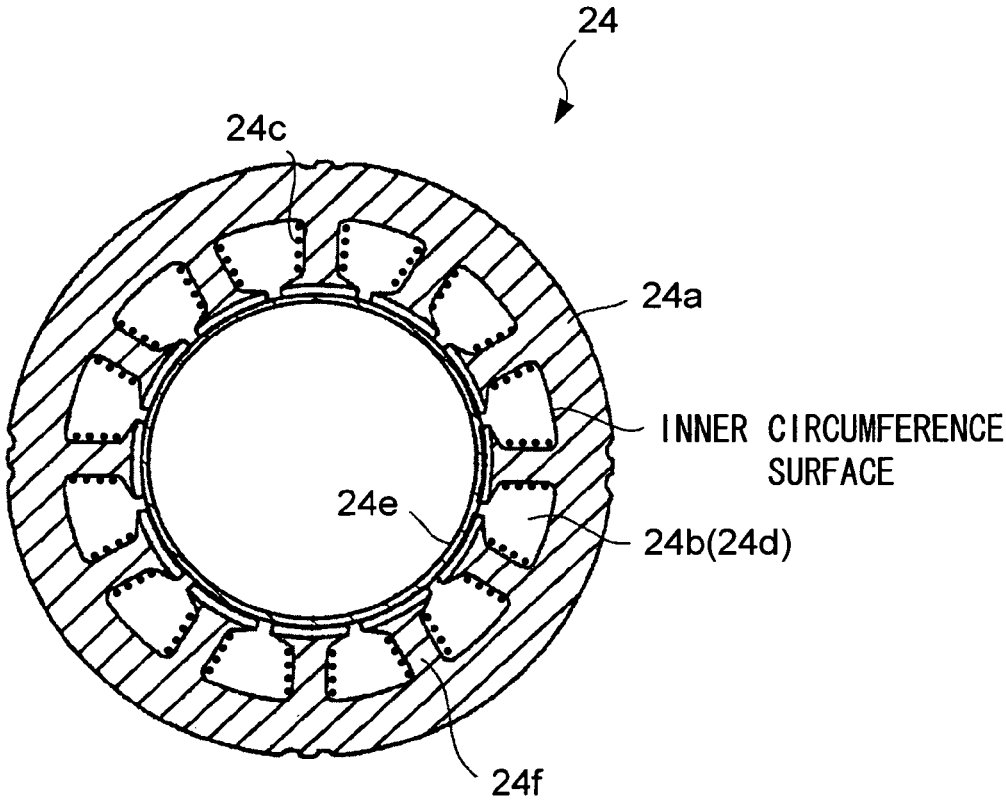
FIG. 5 is a longitudinal cross-sectional view of a stator and a cross-sectional V-V' view of FIG. 2.

As shown in FIG. 1, FIG. 2 and FIG. 5 (a cross-sectional V-V' view of FIG. 2), the stator 24 is a cylindrical electromagnet which is formed so as to cover the rotating shaft 22 and the rotor 23.

To be more precise, the stator 24 is constructed so as to include a cylindrical metal member (for example, iron and the like) 24*a* serving as the main body of the stator 24, stator slots 24*b*, metal wires (for example, enameled wires) 24*c*, motor mold members 24*d* and a stator can 24*e*.

The stator slots 24*b* are installed to stick out (stand) from the inner circumference surface of the metal member 24*a* toward the center (toward the center of the cylindrical longitudinal surface, that is, or in the axial direction of the cylinder).

Furthermore, the stator slots 24*b* are slots which are constructed in a manner that protruding members 24*f* being formed along the same direction as the axial direction of the cylinder (cylinder shaft line) are installed so as to be adjacent to each other. (In other words, the stator slots 24*b* are slots that are formed by installing a plurality of protruding members 24*f* in a radial pattern so as to serve as the center of the cylindrical longitudinal surface.)

Metal wires (winding wires) 24*c* are the wires which wind around the protruding members 24*b* being provided along the axial direction of the cylinder and which constitute an electromagnet.

The motor mold members 24*d* are reinforcement members being made of epoxy resin and the like, for example, and are filled in the slots serving as the stator slots 24*b*.

In addition, the metal wires 24*c* which are wound around the protruding members 24*f* come to be exposed from both ends of the metal member 24*a* (to be exposed in a sticking-out manner). (See FIG. 2 for the exposed portion 24*g*.) Therefore, the motor mold members 24*d* also cover these exposed metal wires 24*c*. (See FIG. 2 for the covered portion 24*h*.)

Moreover, as shown in FIG. 2, the exposed portion 24*g* and the covered portion 24*h* stick out from both ends of the cylindrical metal member 24*a*. (See FIG. 5.) Therefore, the strength of these portions (the exposed portion 24*g* and the covered portion 24*h*) that do not include the metal member 24*a* is reduced.

Consequently, in order to increase the strength in these portions, reinforcement sleeves 24*i* being made of chrome molybdenum steel SCM435 and the like, for example, are inserted so as to cover an inner cylinder consisting of the metal member 24*a* and the motor mold members 24*d*, and the end portions of the stator 24 consisting of the motor mold members 24*d*.

The stator can 24*e* (See FIG. 5.) is a thin-walled cylindrical member for prevention of deposition and is provided so as to cover the inside of the stator 24.

<<Journal Bearings>>

The journal bearings 25 support the rotating shaft 22 by supporting both ends of the rotating shaft 22 so as to enable the rotating shaft 22 to rotate.

In addition, as shown in FIG. 2, a journal bearing 25 being installed to the rotating shaft 22 on the side of the manifold unit 11 serves as the first journal bearing (the first "J" bearing) 25*a*, and a journal bearing 25 being installed to the rotating shaft 22 on the other side (on the opposite side to the side of the manifold unit 11) serves as the second journal bearing (the second "J" bearing) 25*b*.

Figure 6:
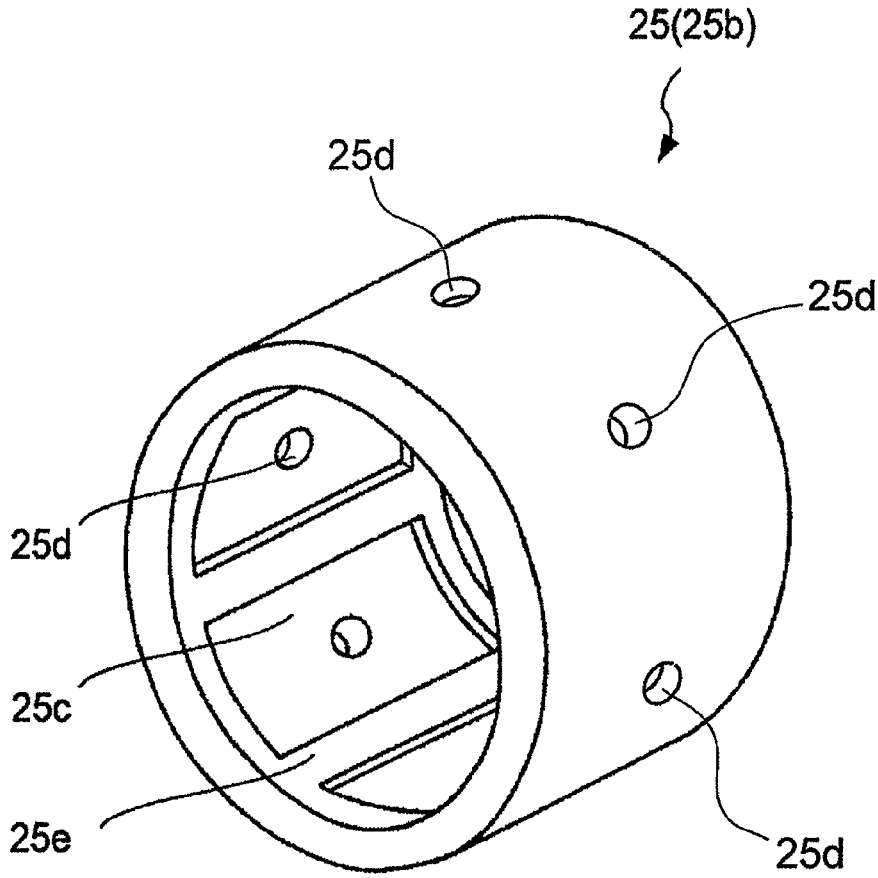
FIG. 6 is a perspective view of the second journal bearing.
Figure 7:
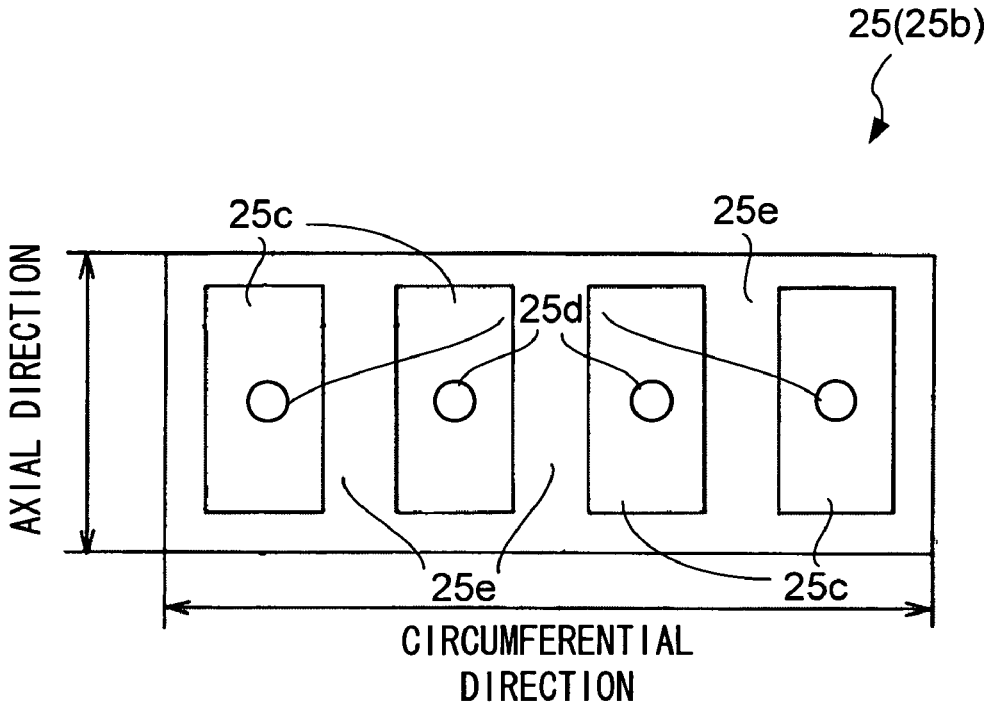
FIG. 7 is a circumferential development view of the second journal bearing.

FIG. 6 is a perspective view of the second "J" bearing 25*b* and FIG. 7 is a circumferential development view of FIG. 6. As shown in these FIG. 6 and FIG. 7, the journal bearings 25 are cylindrical bearings.

Additionally, on the inner circumference of the journal bearings 25, a plurality of recesses 25*c* being shaped so as to hollow from the inner circumference toward the outer circumference (to be in a concave shape) are provided along the circumferential direction so as to be adjacent to each other.

To put it plainly, by providing recesses 25*c*, air gaps (clearances) are made between the journal bearings 25 and the rotating shaft 22. (See FIG. 2.)

Moreover, inside the hollows of the recesses 25*c*, open holes for injection of pressurized fluid ("P" open holes) 25*d* are provided so as to penetrate through the inner circumference (the inner circumference surface) and the outer circumference (the outer circumference surface) of the journal bearings 25 ("P" open holes 25*d* are provided so as to go through continuously.)

Here, the inner circumference portions of the journal bearings 25 excluding the recesses 25*c* (in other words, the portions protruding from the bottom surfaces of the concave recesses 25*c* when the journal bearings 25 are viewed longitudinally) serve as lands 25*e*.

The journal bearings 25 as described hereinabove form a fluid lubrication film (a fluid film) on the outer circumference of the rotating shaft 22 by forcedly supplying high pressure fluid (pressurized fluid) being pressurized outside the journal bearings 25 to the recesses 25*c* via the "P" open holes 25*d* (in other words, into the clearances between the rotating shaft 22 and the recesses 25*c*).

Consequently, load capacity will be generated that can be supported by the journal bearings 25. (Static pressure of the pressurized fluid will be generated.)

Then, by utilizing the load capacity, the journal bearings 25 support the rotating shaft 22 [the load in the radial direction (radial load) against the direction going through the center of the axis of the rotating shaft 22 (the shaft line of the rotating shaft 22)].

To put it plainly, the journal bearings 25 can function as hydrostatic bearings (non-contact type bearings).

In addition, the journal bearings 25 (the first "J" bearing 25*a* and the second "J" bearing 25*b*) function as hydrostatic bearings at least when the above-mentioned recesses 25*c* and the "P" open holes 25*d* are provided.

However, as the first "J" bearing 25*a* being shown in FIG. 2 and FIG. 3, a discharge pathway 25*f* for introducing pressurized fluid to the outside may be provided to the journal bearings 25. (Detailed functions of the discharge pathway 25*f* will be described hereafter.)

<<Main Impeller>>

The main impeller (the first impeller) 26 sucks in fluid being pumped through the suction port 15 of the manifold unit 11 and introduces the fluid being pumped to the discharge port 16 through the cylindrical collector for lubrication 18.

To be more precise, as shown in FIG. 3, the main impeller 26 is constructed by providing a plurality of pieces of blade portions (the first blade portions) 26*b* in a radial pattern (in the radial direction) with the shaft line of the shaft of the impeller (the main impeller shaft 26*a*) serving as the center.

In addition, the main impeller 26 is fixed (joined) by connecting one end of the rotating shaft 22 [specifically, one end (the shaft-end surface) of the rotating shaft 22 on the side of the manifold unit 11] to the main impeller shaft 26*a* with bolts.

Consequently, the main impeller 26 rotates by operating simultaneously at the rotation of the rotating shaft 22. Then, by a centrifugal force being generated by the rotation of the main impeller 26, the fluid being pumped begins to flow through the cylindrical collector for circulation 18. (See FIG. 1.)

In the result, the fluid being pumped flows to the discharge port 16 swiftly.

Here, the first blade portions 26*b* on the side of the shaft end surface of the rotating shaft 22 have side-plates (hollow side-plates serving, that is, the inside main shrouds 26*c*) formed. Additionally, the first blade portions 26*b* on the opposite side to the side of the shaft-end surface of the rotating shaft 22 have side-plates (hollow side-plates serving, that is, the outside main shrouds 26*d*) formed.

To put is simply, the inside main shrouds 26*c* and the outside main shrouds 26*d* (the first side-plates) are provided so as to cover the first blade portions 26*b*.

<<Sub Impeller (Thrust Collar Impeller)>>

The sub impeller 27 supplies pressurized fluid to the journal bearings 25 and the like. (Details will be described hereafter.)

To be more precisely, as shown in FIG. 4, same as the main impeller 26, a plurality of pieces of blade portions (the second blade portions) 27*b* are provided in a radial pattern (in the radial direction) with the axial line of the shaft of the impeller (the sub impeller shaft 27*a*) serving as the center.

Then, the sub impeller 27 is fixed by connecting one end of the rotating shaft 22 where the main impeller 26 is not provided [specifically, one end of the rotating shaft 22 which is on the opposite side to the manifold unit 11] to the sub impeller shaft 27*a* with bolts.

Consequently, the sub impeller 27 rotates by operating simultaneously at the rotation of the rotating shaft 22. Then, by a centrifugal force being generated by the rotation of the sub impeller 27, pressurized fluid begins to flow through the cylindrical collector for bearings 65 (to be described hereafter).

In the result, the pressurized fluid flows to the exhaust nozzle 66 (to be described hereafter) swiftly. (See FIG. 1.)

Here, the second blade portions 27*b* on the side of the shaft end surface of the rotating shaft 22 have side-plates (hollow side-plates serving, that is, the inside sub shrouds 27*c*) formed. Additionally, the second blade portions 27*b* on the opposite side to the side of the shaft end surface of the rotating shaft 22 have side-plates (hollow side-plates serving, that is, the outside sub shrouds 27*d*) formed.

Then, these shrouds (the inside sub shrouds 27*c* and the outside sub shrouds 27*d*) serve as vertical surfaces against the shaft line (in the axial direction) of the sub impeller shaft 27*a*, and additionally, the surfaces are plain surfaces (flat surfaces).

<<Thrust Bearing>>

As shown in FIG. 4, the thrust bearing 28 is a bearing that has a cylindrical cavity into which the shaft end of the rotating shaft having the sub impeller 27 installed is inserted as well as has a clearance which has the flat surfaces of the shrouds of the sub impeller 27 (the inside sub shrouds 27*c* and the outside sub shrouds 27*d*) fit therein.

To be more precise, the thrust bearing 28 consists of the first bearing portion 28*a* into which the shaft end of the rotating shaft 22 is inserted and the second bearing portion 28*b* which has the shrouds (the inside sub shrouds 27*c* and the outside sub shrouds 27*d*) sandwiched with the first bearing portion 28*a* therebetween.

Additionally, each of the bearing portions 28*a* and 28*b* consists of the first cylindrical bodies 28*g* and 28*i* and the second cylindrical bodies 28*h* and 28*j*, respectively The first cylindrical bodies 28*g* and 28*i* in each of the bearing portions 28*a* and 28*b* are cylindrical members having a cavity which is large enough to have the shaft end of the rotating shaft 22 inserted therein.

The second cylindrical bodies 28*h* and 28*j* are cylindrical bodies being installed around the end portions of the first cylindrical bodies 28*g* and 28*i* continuously (so as to be integrally formed) and have a larger outside diameter than the first cylindrical bodies 28*g* and 28*i*.

Then, by having the end surfaces (the bottom surfaces) of the second cylindrical bodies 28*h* and 28*j* face each other, a clearance is provided. (Then, the sub impeller 27 is placed in this clearance.)

Then, the thrust bearing 28 supports the flat surfaces of the shrouds of the sub impeller 27 (the inside sub shrouds 27*c* and the outside sub shrouds 27*d*) by the clearance so as to receive the axial load (the load in the thrust direction) of the rotating shaft 22.

Additionally, in order to receive the load in the thrust direction (the thrust load) in a more stable manner, convex-shaped recesses 28*c* are provided so as to be scattered (in a manner that a plurality of recesses exist in the circumferential direction against the shaft line of the rotating shaft 22) on the surfaces of the clearances facing to the inside sub shrouds 27*c* and the outside sub shrouds 27*d* (specifically, on the end surfaces of the second cylindrical bodies 28*h* and 28*j* in the first bearing portion 28*a* and the second bearing portion 28*b*), and the "P" open holes 28*d* are provided so as to go through the recesses 28*c* continuously (specifically, to go through the clearances continuously).

Then, the pressurized fluid flows into the recesses 28*c* of the thrust bearing 28 through the "P" open holes 28*d* [to be more precise, into the clearances between the recesses 28*c* and the shrouds of the sub impeller 27 (the inside sub shrouds 27*c* and the outside sub shrouds 27*d*)], thereby exerting functions of a hydrostatic bearing (with the static pressure of the pressurized fluid) so as to support the sub impeller 27. The details will be described hereafter.

<Casing>

The casing 19, as described hereinabove, houses the motor 20. To be more precise, as shown in FIG. 1, the casing 19 includes a rotating shaft 22, a rotor 23, a stator 24, journal bearings 25, a main impeller 26, a sub impeller 27, a part of a thrust bearing 28 (the first bearing portion 28*a*), a motor casing 19*a* housing a power socket 39 and an end bell 19*b* housing the remaining portion of the thrust bearing 28 (the second bearing portion 28*b*).

Then, the casing 19 (the motor casing 19*a* and the end bell 19*b*) has various flow pathways provided in order to maintain functions of the journal bearings 25 and the thrust bearing 28 as a hydrostatic bearing.

<<Motor Casing>>

As shown in FIG. 2, the motor casing 19*a* has circumferential slots for the journal bearings 41 and 41 ("J" circumferential slots), inlet open holes 42, outlet open holes 43 and the first circumferential slot for the thrust bearing (the first "S" circumferential slot 45) provided.

The "J" circumferential slots 41 and 41 are slots in a shape of a ring which are provided so as to serve as flow pathways of the pressurized fluid by being connected to the "P" open holes 25*d* and 28*d* of the first "J" bearing 25*a* and the second "J" bearing 25*b*.

To put it plainly, the "J" circumferential slots 41 and 41 are slots which are provided so as to surround the outer circumference of the journal bearings 25 when a motor 20 (specifically, the journal bearings 25) is installed to the inside of the motor casing 19*a*.

The inlet open holes 42 (the first inlet open hole 42*a* and the second inlet open hole 42*b*) are open holes that are connected to suction ports 61 (the first suction port 61*a* and the second suction port 61*b*) of the first bearing unit 13 and the second bearing unit 14 that will be described hereafter.

Then, the inlet open holes 42 are connected to the "J" circumferential slots 41 and 41 (so as to go through continuously).

The outlet open holes 43 (the first outlet open hole 43*a* and the second outlet open hole 43*b*) are open holes for discharging the pressurized fluid being used for hydrostatic bearings and are connected to the discharge ports 62 (the first discharge port 62*a* and the second discharge port 62*b*) of the first bearing unit 13 and the second bearing unit 14 that will be described hereafter.

To be more precise, the first outlet open hole 43*a* is connected to the discharge pathway 25*f* being provided to the first "J" bearing 25*a* by way of a bypass joint (the first bypass joint 44*a*).

Additionally, the second outlet open hole 43*b* is connected to the inner wall of the casing 19 housing the rotating shaft 22 and the rotor 23 by way of two bypass joints (the second bypass joint 44*b* and the third bypass joint 44*c*).

Moreover, the second bypass joint 44*b* (a bypass flow pathway) has the same direction as the flow direction of the pressurized fluid [the same direction as the axial direction (the shaft line) of the rotating shaft 22] in order to make it easy to recover the pressurized fluid that flows through the first inlet open hole 42*a*.

Furthermore, the second bypass joint 44*b* is provided so as to be located between the main impeller 26 and the second outlet open hole 43*b*.

As shown in FIG. 4 and same as the "J" circumferential slots 41 and 41, the first "S" circumferential slot 45 is a slot in a shape of a ring which is provided so as to be connected to the "P" open holes 28*d* of the first bearing portion 28*a* in the thrust bearing 28, serving as a flow pathway of the pressurized fluid.

<<End Bell>>

As shown in FIG. 4 and same as mentioned above, an end bell 19*b* is provided with the second "S" circumferential slot 46 serving as a slot in the circumference and a circulation port for bearings 51.

The second "S" circumferential slot 46 is a slot in a shape of a ring which is connected to the "P" open holes 28*d* of the second bearing portion 28*b* in the thrust bearing 28, serving as a flow pathway of pressurized fluid in the same manner as mentioned above.

The circulation port for bearings 51 is an inlet where the pressurized fluid being supplied to the sub impeller 27 flows in.

Then, the circulation port for bearings 51 is connected to the discharge ports 62 (the first discharge port 62*a* and the second discharge port 62*b*) of the first bearing unit 13 and the second bearing unit 14 that will be described hereafter by using a pipe (a circulation pipe) and the like which are not illustrated herein.

In addition, the circulation pipe is provided with a tank (a tank of pressurized fluid which is not illustrated) that can store fluid which serves as the source of pressurized fluid (for example, water and the like).

Moreover, each flow pathway or each open hole is not limited to the configuration as described hereinabove. To be brief, each flow pathway or each open hole has such configuration as can supply, discharge and the like the pressurized fluid in order that the journal bearings 25 and the thrust bearing 28 can exercise functions as a bearing (for example, as a hydrostatic bearing,).

[[Construction of the First Bearing Unit]]

As shown in FIG. 1, the first bearing unit 13 is installed to the motor unit 12 (specifically, to the casing 19 on the side of the main impeller 26).

Then, the first bearing unit 13 is constructed so as to include the first suction port 61*a*, the first discharge port 62*a* and the first bearing casing 63 which houses the first suction port 61*a* and the first discharge port 62*a*.

<The First Suction Port>

The first suction port 61*a* is an inlet port where pressurized fluid being pneumatically transmitted by the above-mentioned sub impeller 27 flows in.

To be more precise, the first suction port 61*a* is connected to the first inlet open hole 42*a* which is provided to the motor casing 19*a* (so as to go through continuously). (See FIG. 1 and FIG. 2.)

As the result, pressurized fluid flows to the "J" circumferential slots 41 through the first inlet open hole 42*a* and then flows to the "P" open holes 25*d* in the first "J" bearing 25*a*.

<The First Discharge Port>

The first discharge port 62*a* is an outlet port for discharging the pressurized fluid being used for exerting functions as a hydrostatic bearing in the first "J" bearing 25*a* to the outside of the casing 19 (the motor casing 19*a*).

To be more precise, the first discharge port 62*a* is formed so as to be connected to the first outlet hole 43*a* in the casing 19 (to go through continuously). (See FIG. 1 and FIG. 2.)

[[Construction of the Second Bearing Unit]]

As shown in FIG. 1 and FIG. 4, the second bearing unit 14 is installed to the motor unit 12 (specifically, to the casing 19 of the sub impeller 27) in the same manner as the first bearing unit 13.

Then, as shown in FIG. 1, the second bearing unit 14 is constructed so as to include the second suction port 61*b*, the second discharge port 62*b*, inlet open holes for the "S" circumferential slots ("S" inlet open holes 64), a cylindrical collector for bearings 65, an exhaust nozzle 66 and the second bearing casing 67 which houses the second inlet port 61*b*, the second outlet port 62*b*, the "S" inlet open holes 64, the cylindrical collector for bearings 65 and the exhaust nozzle 66.

<The Second Suction Port>

The second suction port 61*b* is an inlet port where pressurized fluid being pneumatically transmitted by the sub impeller 27 flows in in the same manner as mentioned hereinabove.

To be more precise, as shown in FIG. 1 and FIG. 2, the second suction port 61*b* is connected (so as to go through continuously) to the second inlet open hole 42*b* being provided to the motor casing 19*a*.

As a result, pressurized fluid flows to the "J" circumferential slots 41 through the second inlet open hole 42*b* and then flows to the "P" open holes 25*d* in the second "J" bearing 25*b*.

Additionally, as shown in FIG. 1 and FIG. 4, in order to supply pressurized fluid to the thrust bearing 28, the second suction port 61*b* can have the pressurized fluid flow through to the first "S" circumferential slot 45 and the second "S" circumferential slot 46 through the "S" inlet open holes 64 that will be described hereafter.

<The Second Discharge Port>

The second discharge port 62*b* is an outlet port for discharging the pressurized fluid being used for exerting functions as a hydrostatic bearing in the first "J" bearing 25*a* to the outside of the casing 19 in the same manner as described hereinabove.

To be more precise, as shown in FIG. 1 and FIG. 2, the second discharge port 62*b* is formed so as to be connected to the second outlet hole 43*b* in the motor casing 19 (so as to go through continuously).

<Inlet Open Holes for the "S" Circumferential Slots ("S" Inlet Open Holes)>

As shown in FIG. 1 and FIG. 4, the "S" inlet open holes 64 are open holes for supplying the pressurized fluid to the "S" circumferential slots (the first "S" circumferential slot 45 and the second "S" circumferential slot 46.)

Therefore, the "S" inlet open holes are formed so as to be connected (to go through continuously) to the second suction port 61*b* and the "S" circumferential slots (the first "S" circumferential slot 45 and the second "S" circumferential slot 46).

Additionally, the "S" inlet open holes 64 are also connected to the exhaust nozzle 66 in order to make it possible that the pressurized fluid flowing to the exhaust nozzle 66 through the cylindrical collector for bearings 65 which will be described hereafter is used for exercising functions of the thrust bearing 28 as a hydrostatic bearing. (See FIG. 1.)

<Cylindrical Collector for Bearings>

As shown in FIG. 1, the cylindrical collector for bearings 65 is a flow pathway which is formed in a spiral along the axial direction, having the shaft end of the rotating shaft 22, where the sub impeller 27 is installed, serve as the center.

Additionally, the cylindrical collector for bearings 65 is connected to the clearance of the thrust bearing 28. Therefore, pressurized fluid being sent out (pneumatically transmitted) for rotating the sub impeller 27 flows to the exhaust nozzle 66 through this cylindrical collector for bearings 65.

<Exhaust Nozzle>

The exhaust nozzle 66 leads the pressurized fluid flowing through the cylindrical collector for bearings 65 to the first suction port 61*a* and the second suction port 61*b*.

To be more precise, the pressurized fluid is introduced through a pipe and the like (an inlet pipe) not being illustrated which connect this exhaust nozzle 66 to the first suction port 61*a* and the second suction port 61*b*.

[Flow of Liquid Being Pumped and Pressurized Fluid in a Sealless Pump]

The flow of liquid being pumped (fluid being pumped) and that of pressurized fluid in the sealless pump 89 in accordance with the present invention having such construction as mentioned hereinabove will be described hereafter.

[[Flow of Liquid Being Pumped]]

First, a system provided with the sealless pump 89 in accordance with the present invention is operated. Then, electrical power is supplied to the sealless pump 89 via the power socket 39.

Consequently, by receiving the electrical power, in a motor 20 applying a dielectric method, the stator 24 serves an electromagnet, which generates an electric field (a rotating electric field) inside the stator 24.

In consequence, by utilizing a time delay of polarization in the rotor 23 being located inside the stator 24, the rotating shaft 22 begins to rotate.

When the rotating shaft 22 rotates in such a manner as mentioned hereinabove, the main impeller 26 being connected to the rotating shaft 22 rotates, operating simultaneously. Then, by this rotating force, the fluid (liquid being-pumped) being stored in a tank of liquid being pumped which is not illustrated begins to flow in toward the main impeller 26 through the suction port 15. (The liquid being pumped comes to be sucked in.)

By the centrifugal force of this main impeller 26, the liquid being pumped which reaches the main impeller 26 begins to gush out swiftly (to be almost blown about) in a radial direction with the main impeller shaft 26*a* serving as the center.

Then, the liquid being pumped which is supplied with gushing force by the centrifugal force flows into the cylindrical collector for circulation 18 and then flows toward the discharge port 16 by utilizing the gushing force.

As a result, the liquid being pumped returns to the tank of liquid being pumped which is connected to the discharge port 16. (In other words, the liquid being pumped circulates.)

Therefore, when the sealless pump 89 in accordance with the present invention is used, a flow pathway (a loop of liquid being pumped) is established, which is routed from the tank of liquid being pumped (to be specific, the source not being illustrated which liquid being pumped flows into) to a suction pipe (not being illustrated); then to the suction port 15; then to the main impeller 26; then to the cylindrical collector for circulation 18; then to the discharge port 16; then to a discharge pipe; and then to the tank of liquid being pumped (to be specific, a tank not being illustrated which liquid being pumped is discharged to).

[[Flow of Pressurized Fluid]]

On the other hand, when the rotating shaft 22 begins to rotate, the sub impeller 27 begins to rotate, too, in the same manner as the main impeller 26.

Then, by the rotating force being caused by the sub impeller 27, the fluid (pressurized fluid) which is stored in a tank of pressurized fluid not being illustrated flows in toward the sub impeller 27 through a circulation pipe (not being illustrated) and the circulation port for bearings 51. (The pressurized liquid comes to be sucked in).

By the centrifugal force of the sub impeller 27, the pressurized fluid which reaches the sub impeller 27 beings to gush out swiftly (to be almost blown about) in a radial direction with the sub impeller shaft 27*a* serving as the center.

Then, the pressurized liquid which is supplied with gushing force by the centrifugal force flows into the cylindrical collector for bearings 65 and then flows toward the exhaust nozzle 66 by utilizing the gushing force.

A large part of flow of the pressurized fluid flowing out to the exhaust nozzle 66 goes through an inlet pipe (not being illustrated) and is transmitted to the first suction port 61*a* and the second suction port 61*b*.

On the other hand, the remaining flow that is not transmitted to the first suction port 61*a* and the second suction port 61*b* flows to the "S" circumferential slots (the first "S" circumferential slot 45 and the second "S" circumferential slot 46) by way of the "S" inlet open holes 64 which are connected to the exhaust nozzle 66.

Consequently, the pressurized fluid flowing (being pneumatically transmitted) into the first "S" circumferential slot 45 and the second "S" circumferential slot 46 is forced to flow into the recesses 28*c* of the thrust bearings 28 (the first bearing portion 28*a* and the second bearing portion 28*b*) [specifically, the clearances between the recesses 28*c* and the flat surfaces of the shrouds (the inside sub shroud 27*c* and the outside sub shroud 27*d*) of the sub impeller 27]) through the "P" open holes 28*d*.

As a result, on the flat surfaces of the shrouds 27*c* and 27*d* of the sub impeller 27 is formed a fluid-circulation film (and the load capacity is generated).

Therefore, the thrust bearing 28 supports the flat surfaces of the shrouds (the inside sub shroud 27*c* and the outside sub shroud 27*d*) of the sub impeller 27 and receives the thrust load of the rotating shaft 22.

On the other hand, the pressurized fluid flowing to the first suction port 61*a* and the second suction port 61*b* through an inlet pipe reaches the circumferential slots for journal bearings ("J" circumferential slots) 41 and 41 via the first inlet open hole 42*a* and the second inlet open hole 42*b*.

Furthermore, the pressurized fluid is forced to flow from the "J" circumferential slots 41 and 41 into the recesses 25*c* (specifically, the clearances between the rotating shaft 22 and the recesses 25*c*) via the "P" open holes 25*d* of the journal bearings 25 (the first "J" bearing 25 and the second "J" bearing 25*b*). As a result, on the outside circumference of the rotating shaft 22 is formed a fluid-lubrication film.

In consequence, load capacity being sufficient to support the journal bearings 25 is generated. Then, by utilizing the load capacity (fluid-lubrication film), the journal bearings 25 support the rotating shaft 22. (The journal bearings 25 receive the radial load by exerting functions of a hydrostatic bearing.)

Next, the pressurized fluid being utilized as a hydrostatic bearing as described hereinabove, flows to the first outlet open hole 43*a* and the second outlet open hole 43*b*.

Then, furthermore, the pressurized fluid flows to the first discharge port 62*a* and the second discharge port 62*b* from the first outlet open hole 43*a* and the second outlet open hole 43*b*.

After that, because of having a strong gushing force, the pressurized fluid flowing in the above-mentioned manner returns to the circulation port for bearings 51 from the first discharge port 62*a* and the second discharge port 62*b* by way of a circulation pipe (not being illustrated).

Therefore, when the sealless pump 89 in accordance with the present invention is used, a flow pathway (a loop of pressurized fluid) is established, which is routed from the tank of pressurized fluid to a circulation pipe (not being illustrated); then to the circulation port for bearings 51; then to the sub impeller 27; then to the cylindrical collector for bearings 65; then to the exhaust nozzle 66; then to an inlet pipe (not being illustrated); then to the first suction port 61*a* and the second suction port 61*b*: then to the first inlet open hole 42*a* and the second inlet open hole 42*b*; then to the rotating shaft 22; then to the first outlet open hole 43*a* and the second outlet open hole 43*b*; then to the first discharge port 62*a* and the second discharge port 62*b*: then to a circulation pipe; and then to the tank of pressurized fluid.

[[Reason Why Loop of Pressurized Flow and Loop of Liquid Being Pumped Are Not Mixed Up (Functions of the Discharge Pathway)]]

Here, the reason why the loop of pressurized fluid (a circulation flow pathway for bearings) and the loop of liquid being pumped (a circulation pathway for fluid being pumped) are not mixed up at the location where these loops are close to each other, specifically in the proximity of the first "J" bearing 25*a*.

As shown in FIG. 3, when the first "J" journal 25*a* functions as a hydrostatic bearing, pressurized fluid of high pressure entering through the first inlet open hole 42*a* flows into the recesses 25*c* via the "J" circumferential slots 41. After that, the pressurized fluid comes to flow into the discharge pathway 25*f* where the pressure is low.

To put it simply, due to pressure difference between the high pressure area $P_H$ in the proximity of the first inlet open hole 42*a* and "J" circumferential slots and the area of the discharge pathway 25*f* where the pressure is low (the low pressure area $P_L$), the pressurized fluid flows to the discharge pathway 25*f*.

Because the main impeller 26 also rotates when the pressurized fluid flows to the discharge pathway 25*f* as mentioned hereinabove, the pressure in the area in the proximity of the outside diameter portion of the main impeller 26 (the outside diameter area $P_X$) increases.

Then, the pressure of the low pressure area $P_L$ also begins to increase so as to balance with the pressure of the outside diameter area $P_X$.

As a result, no pressure difference is caused between the low pressure area $P_L$ and the outside diameter area $P_X$. In consequence, the pressurized fluid in the loop of pressurized fluid and the liquid being pumped in the loop of liquid being pumped are not mixed but separated.

Additionally, the pressurized fluid flows between the first "J" bearing 25*a* and the second "J" bearing 25*b* (specifically, as shown in FIG. 2, the pressurized fluid being pneumatically transmitted from the first suction port 61*a* flows toward the second discharge port 62*b* via the second connection pipe 44*b*), thereby making it possible to cool the rotating shaft 22, the rotor 23, the stator 24 and the like.

[Various Characteristics of the Sealless Pump in Accordance with the Present Invention]

As mentioned hereinabove, the present invention is a sealless pump 89 which is constructed in a manner that the manifold unit 11 being provided with the suction port 15 and the discharge port 16 is connected to the motor unit 12 being provided with the rotating shaft 22.

In addition, the rotating shaft 22 is supported by the journal bearings 25 that can support without contacting the rotating shaft 22 itself. (For example, hydrostatic bearings which are non-contact type bearings)

Furthermore, one end of both shaft end portions of the rotating shaft 22 has the main impeller 26 installed, while the other end has the sub impeller 27 installed.

Then, the sealless pump 89 in accordance with the present invention sucks in liquid being pumped (fluid being pumped) from the suction port 15 and discharges through the discharge port 16 by utilizing a force (a centrifugal force) being generated by rotation of the main impeller 26.

On the other hand, by utilizing a force (a centrifugal force) which is generated by rotation of the sub impeller 27, in the sealless pump 89 in accordance with the present invention, fluid (pressurized fluid) is transmitted to non-contact type bearings, thereby causing the journal bearings 25 to support the rotating shaft 22.

To be more precise, non-contact type bearings such as hydrostatic bearings and the like are installed so as to have air gaps with the rotating shaft 22 therebetween. Additionally, by transmitting pressurized fluid to the hydrostatic bearings and the like by using the force being generated by rotation, a fluid film is formed in the air gaps between the hydrostatic bearings and the like and the rotating shaft 22.

To put it simply, when non-contact type bearings are as such as the above-mentioned hydrostatic bearings, the sealless pump 89 in accordance with the present invention employs cylindrical journal bearings 25 which surround the rotating shaft 22 as hydrostatic bearings. And, on the inner circumference surfaces of the journal bearings 25 are formed depressed areas which serve as air gaps (specifically, recesses 25*c*).

Then, by having the sub impeller 27 transmit pressurized fluid to the inside of the recesses 25*c*, fluid films are formed inside the recesses 25*c*. In consequence, the fluid films being formed can support the rotating shaft 22 with the static pressure of the fluid.

When the impellers (the main impeller 26 and the sub impeller 27) are installed to both ends of the rotating shaft 22 in the above-mentioned manner, the rotating force (motive energy) of one impeller (the main impeller 26) is used for suction and discharge of liquid being pumped, while the rotating force of the other impeller (the sub impeller 27) is used for supporting the rotating shaft 22.

Consequently, a pressure device (a booster pump and the like) which has conventionally been installed in order to support the rotating shaft 22 becomes unnecessary. In the result, the sealless pump 89 in accordance with the present invention will be a sealless pump which costs low and is downsized (occupying a little space).

Additionally, the sealless pump 89 in accordance with the present invention forms a flow pathway of liquid being pumped (a circulation flow pathway for fluid being pumped), for example, starting from the tank of liquid being pumped (the source not being illustrated where the liquid being pumped flows in) to an inlet pipe (not being illustrated); then to the suction port 15; then to the main impeller 26; then to the cylindrical collector for circulation 18; then to the discharge port 16; then to a discharge pipe; and then to the tank of liquid being pumped (the destination not being illustrated where the liquid being pumped flows in).

In other words, by connecting the suction port 15 and the discharge port 16 with "an inlet pipe, the tank of liquid being pumped and a discharge pipe" (the first flow pathway), a flow pathway of liquid being pumped (a loop of liquid being pumped) is established.

Additionally, the sealless pump 89 in accordance with the present invention forms a flow pathway of pressurized fluid (a loop of pressurized fluid), for example, starting from the tank of pressurized fluid to a circulation pump (not being illustrated) to the circulation port for bearings 51; then to the sub impeller 27; then to the cylindrical collector for bearings 65; then to the exhaust nozzle 66; to an inlet pipe (not being illustrated); then to the first suction port 61*a* and the second suction port 61*b*; then to the first inlet open hole 42*a* and the second inlet open hole 42*b*; then to the rotating shaft 22; then to the first outlet open hole 43*a* and the second outlet open hole 43*b*; then to the first discharge port 62*a* and the second discharge port 62*b*; then to a circulation pipe; and then to the tank of pressurized fluid.

To put it plainly, the sub impeller 27 is connected to the rotating shaft 22 by the "exhaust nozzle 66, an inlet pipe, the first suction port 61*a* and the second suction port 61*b*, and the first inlet open hole 42*a* and the second inlet open hole 42*b*" (the second flow pathway).

Moreover, the rotating shaft 22 is connected to the sub impeller 27 by the "first outlet open hole 43*a* and the second outlet open hole 43*b*, the first discharge port 62*a* and the second discharge port 62*b*, a circulation pipe, the tank of pressurized fluid, a circulation pipe, and the circulation port for bearings 51" (the third flow pathway).

As described hereinabove, the flow pathway of pressurized fluid is established.

By establishing the flow pathway of liquid being pumped and the flow pathway of pressurized fluid independently, the sealless pump 89 in accordance with the present invention makes it possible not to mix the liquid being pumped and the pressurized fluid. As a result, the sealless pump 89 in accordance with the present invention can enjoy various advantages.

For example, there is a benefit when the sealless pump 89 in accordance with the present invention is used for cleaning semiconductors. In accordance with an increase in accumulation degree of semiconductors in recent years, the machining width of semiconductor wafers becomes significantly small (for example, 0.1 μm or less).

Therefore, when the extremely fine semiconductor wafers are cleaned by using conventional liquid such as extra-pure water and the like, there sometimes arises a problem while drying the semi-conductor wafers that the resist being formed in the wafers is destroyed by the capillary force which is caused by the boundary tension of a gaseous product and a liquid.

In order to prevent the above-mentioned problem, such a semiconductor cleaning method is developed as uses supercritical fluid (supercritical $CO_2$ fluid or liquid $CO_2$) in place of liquid such as extra-pure water and the like.

Supercritical fluid has a very high permeability, compared with the liquid, and permeates into a very fine structure of any kind. Therefore, an interface between gas and liquid does not exist, which provides the supercritical fluid with a characteristic that the capillary force does not work while drying.

And now, when small bubbles and dusts and the like (particles and the like) are generated in the cleaning agent (supercritical fluid) in such cleaning of semiconductor wafers by using supercritical fluid as mentioned hereinabove, the wiring on semiconductor wafers is sometimes destroyed due to the particles.

However, the sealless pump 89 in accordance with the present invention employs the supercritical fluid as liquid being pumped and can clean the semiconductor wafers, for example, inside a tank of liquid being pumped.

In other words, if particles and the like being attributable to the hydrostatic bearings are generated when the semi-conductor wafers are cleaned by driving the sealless pump 89 in accordance with the present invention and when the hydrostatic bearings that support the rotating shaft 22 are functioning at the same time, the particles and the like will not be introduced into the tank of liquid being pumped.

It is because the supercritical fluid serving as the liquid being pumped (the fluid being pumped) circulates in the loop of liquid being pumped, while the fluid which is to be used for hydrostatic bearings (the pressurized fluid) circulates in the loop of pressurized fluid, so that both loops do not get mixed.

In consequence, the sealless pump 89 in accordance with the present invention is optimized for a system which does not like particles and the like to exist in the liquid being pumped (such as a semiconductor cleaning system and the like).

Second Embodiment

The second embodiment of the present invention will be described hereafter. Same symbols will be supplied to the members having the same functions as the members being employed for the first embodiment and the explanation thereof will be omitted.

As explained for the first embodiment, the sealless pump 89 in accordance with the present invention establishes two flow pathways (loops), the loop of liquid being pumped and the loop of pressurized fluid, each of which is independent.

When the two independent flow pathways are established as described hereinabove, it is very effective to employ the sealless pump 89 in accordance with the present invention to such a system as does not like particles and the like to exist in the liquid being pumped (such as a semiconductor cleaning system and the like).

And now, the above-mentioned supercritical $CO_2$ fluid which cleans semiconductor wafers is generated by having carbon dioxide ($CO_2$) change to be in a condition in which the critical temperature (about 31.1° C.) and the critical pressure (about 7.38 Mpa) are exceeded.

Then, when the semiconductor wafers are cleaned by using the supercritical $CO_2$ fluid, there is sometimes a case where semiconductors are desired to be cleaned at higher temperature (for example, at the temperature about 200° C.).

Figure 8:
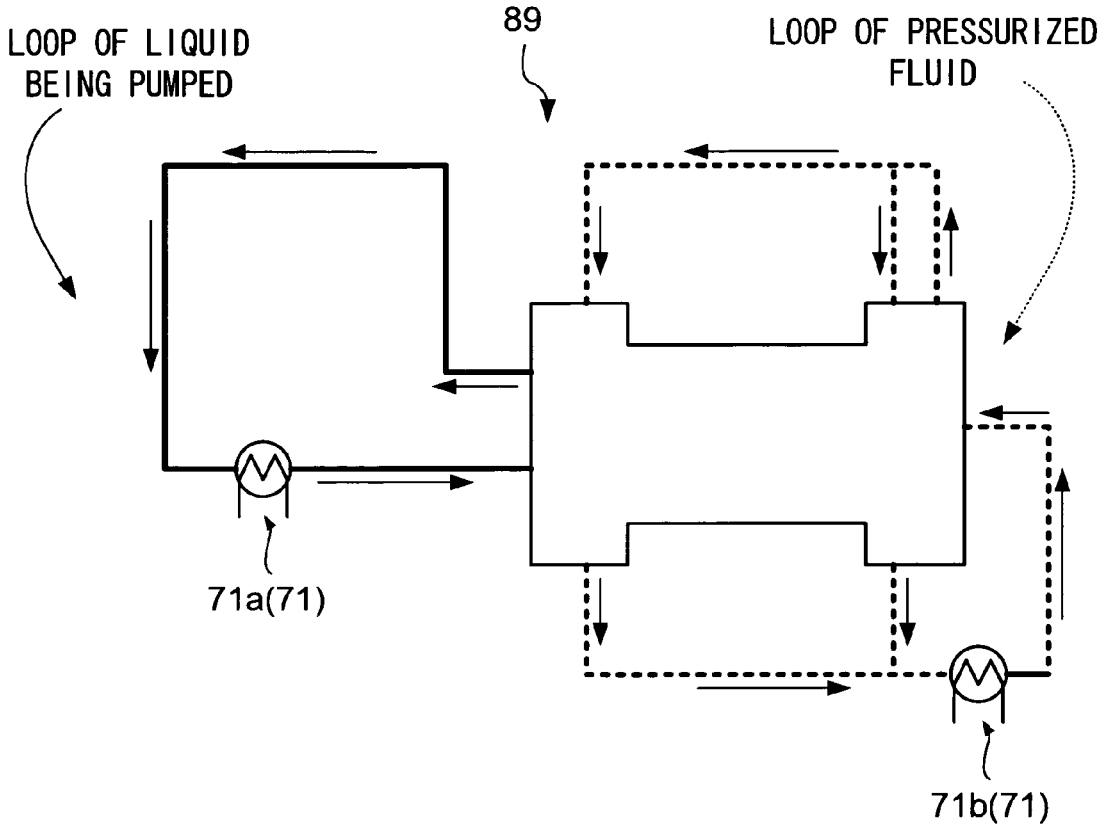
FIG. 8 is a schematic block diagram depicting a loop of liquid being pumped and a loop of pressurized fluid.

Therefore, as shown in FIG. 8, the sealless pump 89 in accordance with the present invention has a heat exchanger 71 (a heating equipment 71*a* and the like) installed in the loop of liquid being pumped.

On the other hand, the pressurized fluid to be used for hydrostatic bearings does not need to be high temperature like the liquid being pumped. Or rather, there is a case where it is preferable that the temperature is low (for example, as low as 60° C.) in order to cool the rotating shaft 22, the rotor 23, the stator 24 and the like.

Therefore, the sealless pump 89 in accordance with the present invention has another heat exchanger 71 (a cooling equipment 71*b* and the like) installed in the loop of pressurized fluid, separately from the heat exchanger 71*a* in the loop of liquid being pumped.

To put it plainly, the sealless pump 89 in accordance with the present invention is provided with separate heat exchangers 71*a* and 71*b* in the loop of liquid being pumped and the loop of pressurized fluid, respectively.

Therefore, the sealless pump 89 in accordance with the present invention can have the temperature of the loop of liquid being pumped and that of the loop of pressurized differ respectively.

Then, for example, although it is necessary to set the temperature of the liquid being pumped high, it becomes unnecessary to enhance the allowable temperature limit of the motor 20 (the rotating shaft 22, the rotor 23, the stator 24 and the like).

As a result, in the sealless pump 89 in accordance with the present invention, a motor 20 employing a material which has a low allowable temperature limit can be used, thereby producing a sealless pump which costs low.

Third Embodiment

The third embodiment of the present invention will be described hereafter. Same symbols will be provided to the members having the same functions as the members being employed for the first and the second embodiments and the explanation thereof will be omitted.

As explained in the first and the second embodiments, one of characteristics of the sealless pump 89 in accordance with the present invention is that in addition to the main impeller 26, a sub impeller 27 is installed to the rotating shaft 22.

Therefore, in the present embodiment, the sub impeller 27 will be explained in more details.

As mentioned hereinabove, the sub impeller 27 is installed so as to be located in the clearance which is provided to the thrust bearing 28.

Then, the sub impeller 27 has an ability to transmit the pressurized fluid which is used for hydrostatic bearings and an ability to receive the thrust load which is generated by rotation of the rotating shaft 22.

One factor which dominates the ability to transmit the pressurized fluid is a size and configuration of the sub impeller 27.

On the other hand, one factor which dominates an ability to receive the thrust load is a size and configuration of the shrouds (the inside sub shroud 27*c* and the outside sub shroud 27*d*).

Then, the sub impeller 27 of the sealless pump 89 in accordance with the present invention is so designed as to have the size of the second blade portions 27*b* and the size of the shrouds 27*c* and 27*d* become optimized separately.

To put it briefly, the sealless pump 89 in accordance with the present invention can handle a case where there is a difference between the size of the sub impeller 27 which can generate optimum pressure of the pressurized fluid for supply and the size of the shrouds 27*c* and 27*d* which generate necessary load capacity for receiving the thrust load, both of which are necessary for designing hydrostatic bearings.

Figure 9:
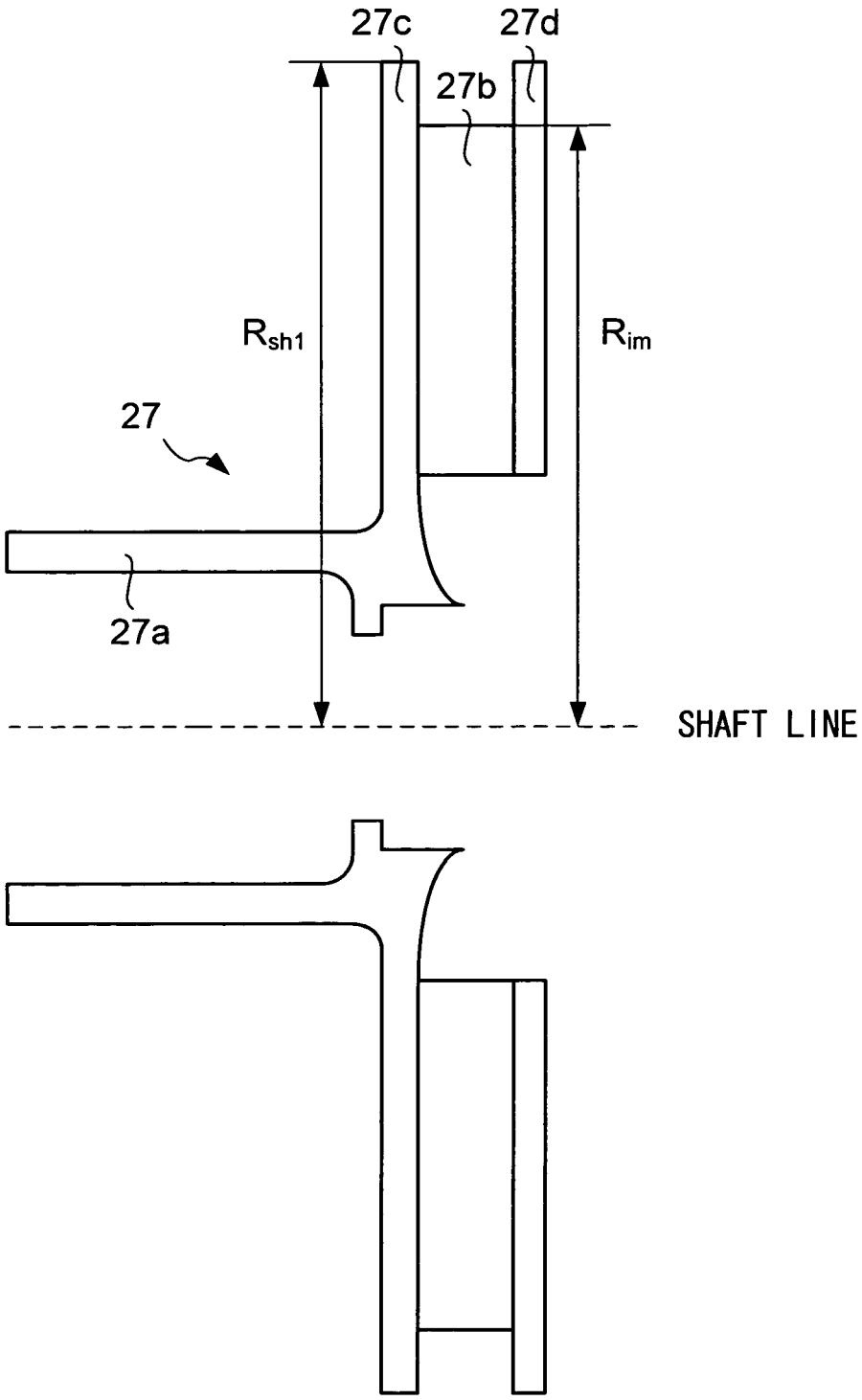
FIG. 9 is a longitudinal cross-sectional view of the sub impeller.

To be more precise, as shown in FIG. 9, the second blade portions 27*b* being installed in the radial direction (for example, being vertical) to the direction (the shaft line) going through the center of the sub impeller shaft 27*a* in the sub impeller 27 can be designed by changing the distance form the shaft line to the most outside edges of the second blade portions 27*b* [the length of the radius ($R_{im}$) from the shaft line] appropriately.

On the other hand, the shrouds 27*c* and 27*d* which are installed so as to hold the rotating surfaces of the second blade portions 27*b* are designed by changing the distance from the shaft line of the sub impeller shaft 27*a* to the most outside edges of the shrouds 27*c* and 27*d* [the length of the radius from the shaft line ($R_{sh1}$)] appropriately.

To put it plainly, in the sealless pump 89 in accordance with the present invention, while the second blade portions 27*b* are designed by using the length of the radius ($R_{im}$) from the shaft line of the sub impeller shaft 27*a*, the shrouds 27*c* and 27*d* are designed by using the length of the radius ($R_{sh1}$) from the shaft line of the sub impeller shaft 27*a*.

As a result, by designing the length of the radius ($R_{im}$) and the length of the radius ($R_{sh1}$) to be optimum accordingly, the sealless pump 89 in accordance with the present invention can maximize the capability to transmit the pressurized fluid which is to be used for hydrostatic bearings and the capability to receive the thrust load which is generated by rotation of the rotating shaft 22.

In other words, the sub impeller 27 can also carry out a function as a thrust collar. Therefore, the sub impeller 27 can be expressed as a "thrust collar impeller."

Moreover, these shrouds (the inside sub shroud 27*c* and the outside sub shroud 27*d*) serve as vertical surfaces against the axial direction (the shaft line) of the sub impeller shaft 27*a*, and in addition, the surfaces are plain (flat).

Therefore, it is easy to receive the pressurized fluid flowing through the "P" open hole 28*d* of the thrust bearing 28 on the flat surfaces, which enhances the functions of the thrust bearing 28 to serve as a hydrostatic bearing.

Fourth Embodiment

The fourth embodiment of the present invention will be described hereafter. Same symbols will be supplied to the members having the same functions as the members being employed for the first through the third embodiments, and the explanation thereof will be omitted.

As explained for the first through the third embodiments, in the sealless pump 89 in accordance with the present invention, the rotating shaft 22 where the main impeller 26 and the sub impeller 27 are installed rotates.

Therefore, thrust load and the like are generated by rotation of the rotating shaft 22. Consequently, in this embodiment, countermeasures (Countermeasure 1 and Countermeasure 2) will be described to cope with the thrust loads which are applied to the sealless pump 89 in accordance with the present invention (specifically, hydrostatic thrust load heading for the sub impeller 27 from the main impeller 26).

[Countermeasure 1]

As described in the first embodiment, the sealless pump 89 in accordance with the present invention employs the main impeller (the first impeller) 26 to which the shrouds (the inside main shroud 26*c* and the outside main shroud 26*d*) are provided. (See FIG. 3.)

Then, when the main impeller 26 tries to transmit the liquid being pumped from the suction port 15 to the discharge port 16, the area in the proximity of the first blade portions 26*b* and the shrouds (the inside main shroud 26*c* and the outside main shroud 26*d*) which are close to the discharge port 16 becomes high pressure (the discharge-pressure area A) in order to send out the liquid being pumped.

Then, a differential pressure is caused between the discharge-pressure area A of high pressure and the proximity of the outside main shroud 26*d* (the suction-pressure area B) which is close to the side of the suction port 15. As a result, there sometimes arises a leaking flow from the discharge port 16 to the suction port 15.

Therefore, the sealless pump 89 in accordance with the present invention has a wear ring 72 (a cylindrical filling member) between the shroud (the outside main shroud 26*d*) of the main impeller 26 and the inner wall of the manifold casing 17 where the main impeller 26 is located.

The wear ring 72 is a cylindrical body and is installed in a manner that an end surface (edge portion) of the cylindrical body faces the first confronting surface which will be described hereafter and wraps up the outside main shroud 26*d*. (The wear ring 72 is installed between the outside main shroud 26*d* and the inner wall of the manifold casing 17 so as to surround and come close to the outside main shroud 26*d*).

In the result, the wear ring 72 serves as a barrier between the discharge-pressure area A and the suction-pressure area B, thereby enabling to back up the above-mentioned leaking flow.

Here, in the sealless pump 89 in accordance with the present invention, the thrust load is adjusted by changing the inside diameter of the wear ring 72 (the wear-ring inside diameter which can be expressed differently as the first outside diameter of the outside main shroud 26*d*) in various ways.

Specifically, the wear-ring inside diameter can be changed by adjusting the length of the radius ($R_w$) from the direction (the shaft line) going through the center of the cylinder shaft of the wear ring 72.

Additionally, the outside main shroud 26*d* comes to be attached to the inside diameter of the wear ring 72. Therefore, the first outside diameter of the shroud has approximately same diameter as the inside diameter of the wear ring 72.

Figure 10A:
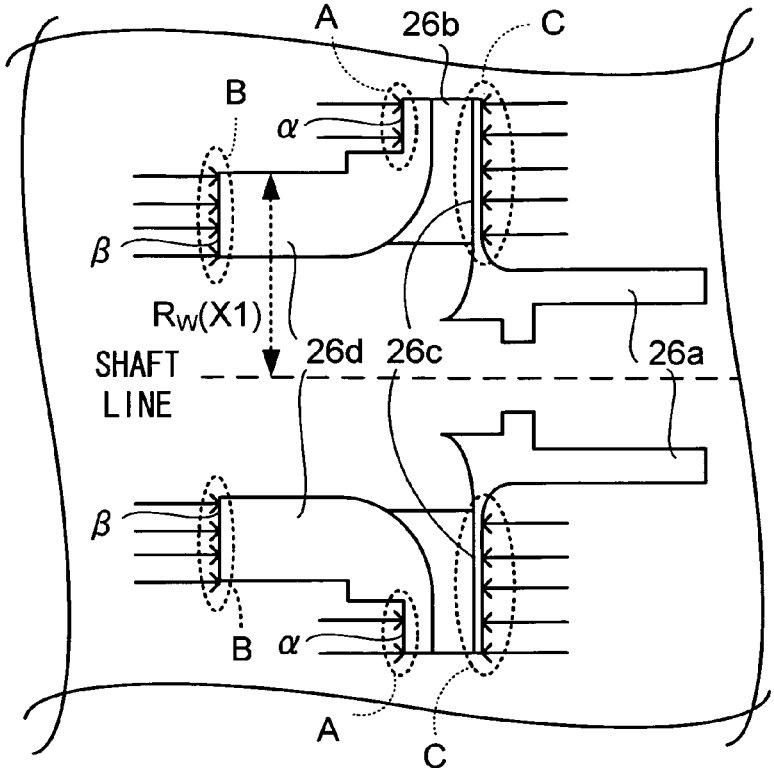
FIG. 10A is a view explaining the first confronting surface and the second confronting surface in the main impeller when the first confronting surface is smaller than the second confronting surface.

As shown in FIG. 10A, in the sealless pump 89 in accordance with the present invention, the inside diameter of a wear ring (the length of the radius $R_w$=X1) is increased. This will be explained hereafter by referring to FIG. 10B serving as a comparative example.

Figure 10B:
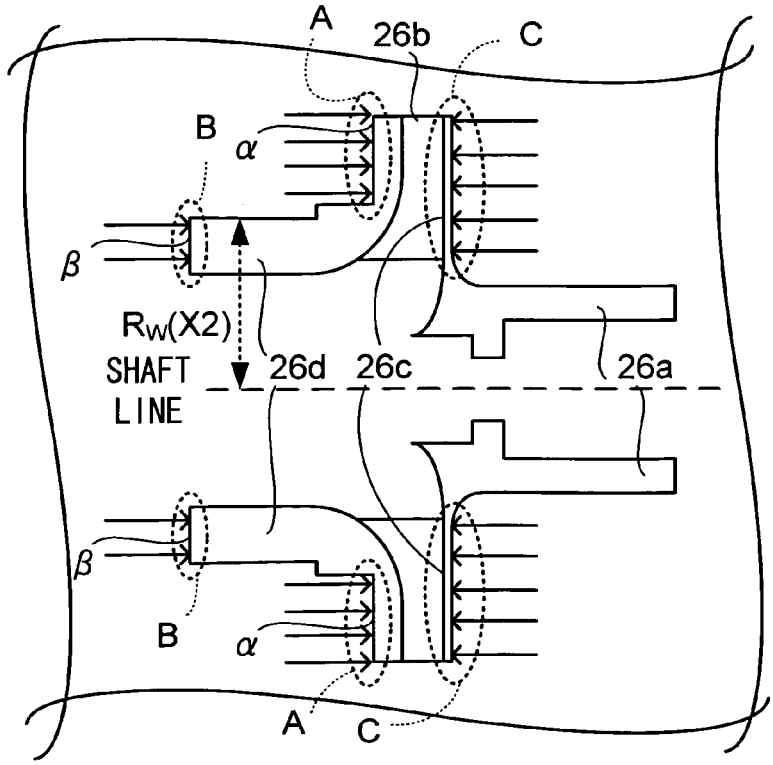
FIG. 10B is a view explaining the first confronting surface and the second confronting surface in the main impeller when the first confronting surface is larger than the second confronting surface.
Figure 11:
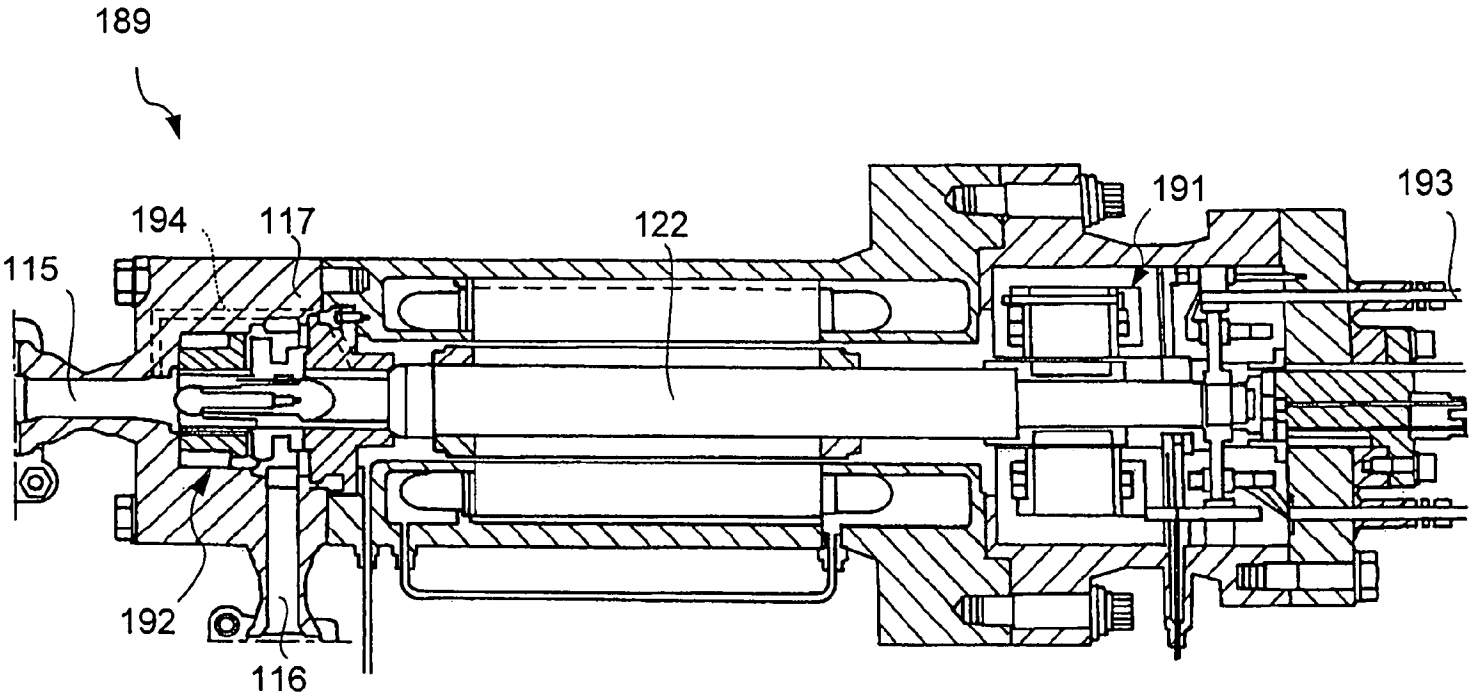
FIG. 11 is a longitudinal cross-sectional view of a conventional sealless pump.

In FIG. 10B, the inside diameter of the wear ring is X2 which is smaller than X1. In consequence, in the discharge-pressure area A where the pressure is high, the region where the pressurized fluid presses the outside main shroud 26*d* (the first confronting surface α) is large.

And, in the suction-pressure area B where the pressure is low, the region where the pressurized fluid presses the outside main shroud 26*d* (the second confronting surface β) is small.

In the meanwhile, as shown in FIG. 10A, being compared with a comparative example in which the inside diameter of the wear ring (the length of the radius $R_w$=X1) is increased, in the discharge-pressure area A where the pressure is high, the region where the pressurized fluid presses the outside main shroud 26*d* (the area of the first confronting surface α) becomes small.

On the contrary, in the suction-pressure area B where the pressure is low, the region (the area) where the pressurized fluid presses the outside main shroud 26*d* (the area of the second confronting surface β) becomes larger.

In addition, in either FIG. 10A or FIG. 10B, the pressures being supplied by the end surface of the rotating shaft 22 to press the surface of the inside main shroud 26*c* is the same. (See the area C.)

Then, in FIG. 10A, in the discharge-pressure area A where the pressure is high, the pressure from the main impeller 26 to the sub impeller 27 is reduced because the region where the pressurized fluid presses the outside main shroud 26*d* (the first confronting surface α) becomes small.

Consequently, the pressure being supplied by the end surface of the rotating shaft 22 to press the inside main shroud 26*c* (specifically, the pressure from the sub impeller 27 to the main impeller 26) becomes large. As a result, the thrust load can be reduced.

To put it simply, in the sealless pump 89 in accordance with the present invention, the outside main shroud 26*d* (the first side-plate) is designed so as to have the first confronting surface α and the second confronting surface β face each other in the direction from the suction port 15 to the first blade portions 26*b* of the main impeller 26.

Moreover, the first confronting surface α is located so as to be in the proximity of the discharge port 15 and the second confronting surface β is located so as to be in the proximity of the suction port 16. Then, the areas of the first confronting surface α and the second confronting surface β are adjusted.

And, such adjustment is made in a manner that as shown in FIG. 10A, the first confronting surface becomes smaller than the second confronting surface.

Additionally, the inside diameter $R_w$ of a wear ring (to express differently, the first outside diameter of the outside main shroud 26*d*; or the distance from the shaft line to the location which is close to the inner circumference of the wear ring 72 and the outside main shroud 26*d*) can be adjusted as mentioned hereinabove.

However, the inside diameter of the outside main shroud 26*d* ($R_{in}$) and the second outside diameter of the outside main shroud 26*d* ($R_o$ which is the distance from the shaft line to the most outside edge of the outside main shroud 26*d*) cannot be changed. (See FIG. 3.)

[Countermeasure 2]

There is another countermeasure which can change the direction of the pressurized fluid flowing around the rotating shaft 22, the rotor 23 and the like.

In FIG. 2, a second bypass joint 44*b* is oriented in the same direction as the axial direction (the shaft line) of the rotating shaft 22 and connected to the second outlet open hole 43*b*

Therefore, the pressurized fluid flowing through the first suction port 61*a* and the first inlet open hole 42*a* can flow easily to the second bypass joint 44*b*, going through between the inner wall of the casing 19 housing the rotating shaft 22 and the rotor 23 (the motor casing 19*a*) and the rotating shaft 22 and the rotor 23.

In this case, between the rotor 23 and the above-mentioned inner wall (to describe in details, between the rotor 23 and the stator 24) is formed a significantly narrow space. Therefore, pressure loss will be generated.

Additionally, suppose that a centrifugal force is caused by rotation of the rotating shaft. In such a case, a space between the end portion of the rotor 23 on the side of the main impeller 26 and the inner wall of the casing 19 (for example, the space "D") and a space between the end portion of the rotor 23 of the side of the sub impeller 27 and the inner wall of the casing 19

(for example, the space "E") has such a pressure distribution as the inside portion becomes low pressure and the outside portion becomes high pressure in the radial direction against the shaft line of the rotating shaft 22.

Then, in the space "D," due to friction resistance accompanied by the flow of the pressurized fluid (a flow from the inside portion to the outside portion in the above-mentioned radial direction), the pressure distribution becomes such as the inside portion is high pressure while the outside portion is low pressure in the above-mentioned radial direction.

In the contrary, in the space "E," due to friction resistance accompanied by the flow of the pressurized fluid (a flow from the outside portion to the inside portion in the above-mentioned radial direction), the pressure distribution becomes such as the inside portion is low pressure while the outside portion is high pressure in the above-mentioned radial direction.

And, in the space "D," due to contradictory pressure distribution, the more the flow of pressurized fluid becomes, the smaller the static pressure becomes. However, on the contrary, in the space "E," because the pressure distribution is similar, the static pressure becomes large.

Then, although the static pressure in the space "D" and the space "E" changes as mentioned hereinabove, a pressure difference (a difference in static pressure) occurs between both spaces (the space "D" and the space "E"). [Pressure of the space "D">Pressure of the space "E"].

Consequently, due to the above-mentioned pressure loss and difference in static pressure, thrust load (hydrostatic thrust load) is generated from the main impeller 26 toward the sub impeller 27.

Then, in the sealless pump 89 in accordance with the present invention, the second bypass joint 44*b* connects the inner wall of the casing 19 housing the rotating shaft 22 and the rotor 23 to the first outlet open hole 43*a*.

To put it plainly, in order that the second bypass joint 44*b* can easily recover the pressurized fluid flowing through the second inlet open hole 42*b*, the second bypass joint 44*b* is provided so as to be oriented in the same direction as the axial direction (the shaft line) of the rotating shaft 22 and to be located between the sub impeller 27 and the first outlet open hole 43*a*.

Installing the second bypass joint 44*b* in the above-mentioned manner makes the pressure relation between the space "D" and the space "E" be 'pressure of the space "D"<pressure of the space "E."'

Additionally, between the rotor 23 and the stator 24, a pressure loss is generated between the upstream and the downstream of the flow of the pressurized fluid.

Therefore, due to the above-mentioned pressure loss and difference in static pressure (the pressure of the space "D"<the pressure of the space "E"), hydrostatic thrust load will be generated from the sub impeller 27 toward the main impeller 26.

Then, the hydrostatic thrust load becomes a load in the opposite direction to the thrust load being caused by rotation of the rotating shaft 22 which the main impeller 26 and the sub impeller 27 are installed to (a load from the main impeller 26 to the sub impeller 27).

Therefore, in the sealless pump 89 in accordance with the present invention, the thrust load can be adjusted by changing the position of the second bypass joint 44*b*.

In other words, in the sealless pump 89 in accordance with the present invention, by using a force being generated by rotation of the sub impeller 27, the pressurized fluid flowing to the thrust bearing 28 being provided to the rotating shaft 22 is made to flow in the direction from the sub impeller 27 to the main impeller 26.

To be more precise, the second bypass joint 44*b* going continuously through the inside and the outside of the casing 19 housing the rotating shaft 22 is provided to the casing 19 on the side of the main impeller 26. (In other words, the second bypass joint 44*b*, the first outlet open hole 43*a* and the first discharge port 62*a* are connected through continuously.)

Other Embodiments

In addition, it is to be understood that the present invention may be carried out in any other manner than specifically described above as embodiments, and many modifications and variations are possible within the scope of the invention.

For example, the above description explains a case in which the journal bearings 25 fulfill functions as hydrostatic bearings. However, not limited to, but other non-contact type bearings (for example, hydrodynamic bearings, magnetic bearings, and the like) may be permissible.

In addition, in the above-mentioned description, a liquid being pumped is explained by taking the supercritical CO2 fluid as an example, but not limited to. To put it simply, other fluids (for example, gas, chemicals, water and the like or fluids of low viscosity or high viscosity, fluids of extremely high temperature or extremely low temperature and the like) may be acceptable.

Moreover, a suction pipe being connected to the suction port 15, a discharge pipe being connected to the discharge port 16 and a tank of liquid being pumped to which these suction pipe and discharge pipe are connected are examples, and not limited to.

The point is that as long as the pipes and tanks can establish a loop of liquid being pumped, these (the pipes and tanks) may have any configuration and may be installed to any location.

Additionally, same as mentioned hereinabove, an inlet pipe connecting the exhaust nozzle 66 to the first suction port 61*a* and the second suction port 61*b*, a circulation pipe connecting the circulation port for bearings 51 to the first discharge port 62*a* and the second discharge port 62*b* and a tank of pressurized fluid being installed in the circulation pipe are examples and not limited to.

What matters is as long as the pipes and tanks can establish a loop of pressurized fluid, these (the pipes and tanks) may have any configuration and may be installed to any location.

Moreover, in order to have the pressurized fluid flowing to the thrust bearing 28 being provided to the rotating shaft 22 flow from the sub impeller 27 to the main impeller 26, the pressurized fluid on the side of the first suction port 61 may be high pressure, and at the same time, the pressurized fluid may flow to the second suction port in a pressure being lower than this high pressure (in low pressure).

The embodiments of the present invention which are described hereinabove can also be explained as follows.

To be more precise, in the sealless pump in accordance with the present invention, non-contact type bearings are installed so as to have air gaps with the rotating shaft therebetween, wherein the second impeller transmits fluid to the non-contact type bearings by using a force being generated by rotation, thereby forming fluid films in the air gaps between the non-contact type bearings and the rotating shaft.

To describe in details further, the non-contact type bearings are cylindrical journal bearings surrounding the rotating shaft, wherein depressed areas serving as air gaps are formed on the inner circumference surfaces of the journal bearings;

and the second impeller transmits fluid into the depressed areas, thereby forming the fluid films inside the depressed areas; and wherein, the fluid films being formed support the rotating shaft with the pressure of the fluid (static pressure).

Additionally, in the sealless pump in accordance with the embodiment of the present invention, by providing the first flow pathway which connects the suction port to the discharge port, the fluid being formed forms a circulation flow pathway for fluid being pumped where the fluid being pumped circulates between the suction port and the discharge port.

Furthermore, in the sealless pump in accordance with the present invention, it is preferable that a circulation flow pathway for bearings where the fluid circulates between the second impeller and the non-contact type bearings is formed by connecting the second flow pathway where the fluid being transmitted from the second impeller flows to the non-contact type bearings to the third flow pathway where the fluid reaching the non-contact type bearings flows further to the second impeller, In this case, in the sealless pump in accordance with the present invention, it is possible not to have the pumping fluid and the fluid get mixed up by separating the flow pathway where the fluid being pumped flows (a circulation flow pathway for the fluid being pumped) from the flow pathway where the fluid (fluid for bearings or pressurized fluid) flows (a circulation flow pathway for bearings).

Therefore, when fluid being pumped is used for an application such as cleaning and the like [for example, in a case where bubbles and dusts and the like (particles) come into the pumping liquid so as to have the particles damage an object to be cleaned], especially advantages are exerted.

To put it plainly, in the present invention, when an object to be cleaned is cleaned by operating a sealless pump and when hydrostatic bearings and the like supporting the rotating shaft fulfill functions thereof at the same time, particles and the like being attributed to hydrostatic bearings and the like will not flow into the liquid being pumped and get mixed even though these particles and the like might be generated.

Therefore, the sealless pump in accordance with the present invention is optimum for a system which does not like intrusion of particles and the like into the liquid being pumped (such as a semiconductor cleaning system and the like).

In addition, in the sealless pump in accordance with the present invention, it is preferable that a heat exchanger is installed to the circulation flow pathway for bearings. Furthermore, it is preferable that each separate heat exchanger is installed to the circulation flow pathway for fluid being pumped and to the circulation flow pathway for bearings, respectively.

In this case, the temperature of the circulation flow pathway for fluid being pumped and the temperature of the circulation flow pathway for bearings can be adjusted separately.

Moreover, the sealless pump in accordance with the present invention has the second impeller intervene on the shaft end portion of the rotating shaft, wherein a thrust bearing is installed which supports a load of the rotating shaft in the thrust direction.

Additionally, it is preferable that the second impeller transmits fluid to the thrust bearing by using a force being generated by rotation, thereby forming a fluid film between the thrust bearing and the second impeller.

To be more precise, the said second impeller has second blade portions installed in a radial direction against a shaft line of the second impeller, and has second side-plates installed so as to hold rotating surfaces of the second blade portions.

Additionally, the second side-plate is provided so as to be held by the clearances being provided to the thrust bearing and so as to have a clearance between the second side-plate and the clearances.

Moreover, the second impeller forms a fluid film between the second side-plate and the thrust bearing by transmitting fluid to the clearance by using a force which is generated by rotation.

To describe in details, on a surface composing a clearance of the thrust bearing is formed a depressed area which serves as a clearance between the second side-plate and the clearance.

Furthermore, the second impeller forms a fluid film inside the depressed area, by transmitting fluid into the depressed area, wherein the fluid film being formed supports the second impeller with static pressure of the fluid.

In this case, the sealless pump in accordance with the present invention can receive even a load in the thrust direction (a thrust load) of the rotating shaft by further utilizing a rotating force being generated by the second impeller.

First, by having the second impeller intervene in the clearance inside the thrust bearing and by providing the second impeller with the second side-plate, a clearance can receive the thrust load by way of the second side-plate.

In addition, by forming a fluid film between the clearance and the second side-plate (for example, with the pressure of a fluid film), the second impeller and then the rotating shaft which moves in the thrust direction can be supported stably.

Moreover, in the sealless pump in accordance with the present invention, it is preferable that the second side-plate of the second impeller is a plane surface which is vertical to the shaft line of the second impeller.

In this way, because fluid flowing into the depressed areas can be caught by the entire plane surface, the thrust bearing can enhance functions thereof (functions as a hydrostatic bearing) when it is a hydrostatic bearing.

Additionally, in the sealless pump in accordance with the present invention, it is preferable that the distance from the shaft line to the most outside edge of the second blade portions in the second blade portions being provided radially against the shaft line of the second impeller and the distance from the shaft line to the most outside edge of the second side-plate in the second side-plate being provided so as to hold the rotating surfaces of the second blade portions can be adjusted respectively.

One contributing factor which affects the capability to send out pressurized fluid is the size and configuration of the second impeller. At the same time, a contributing factor which affects the capability to support the second impeller (specifically, the capability to support a thrust load being generated by rotation of the rotating shaft) is the size and configuration of a side-plate of the second impeller.

Therefore, in the sealless pump in accordance with the present invention, the distance from the shaft line of the second impeller to the most outside edge of the second blade portions that affects the capability to send out pressurized fluid and the distance between the shaft line of the second impeller to the most outside edge of the second side-plate that affects the capability to support a thrust load can be designed in an appropriate manner so as to achieve the optimum distance.

In consequence, the capability to send out the pressurized fluid to be used for hydrostatic bearings and the capability to receive a thrust load being generated by rotation of the rotating shaft can be optimized.

Additionally, in the sealless pump in accordance with the present invention wherein the said first impeller has first blade portion installed in a radial direction against a shaft line of the first impeller, and has first side-plates installed so as to cover the rotating surface of the suction-port-side first blade portion.

Moreover, the first side-plate has the first confronting surface ("α" in FIG. 10A and FIG. 10B) and the second confronting surface "β" in FIG. 10A and FIG. 10B) which face each other against the direction from the suction port to the first blade portions; wherein the first confronting surface is positioned in the proximity of the discharge port while the second confronting surface is positioned in the proximity of the suction port.

In addition, it is preferable that the areas of the first confronting surface and the second confronting surface can be adjusted.

To be more precise, cylindrical filling members are provided. The cylindrical filling members have such edge portions as face toward the first confronting surface and at the same time are placed close to a space between the first side-plate and the inner wall of a manifold casing of the manifold unit so as to surround the first side-plate in order that liquid being pumped will be prevented from leaking to the suction port from the discharge port.

Then, by adjusting the inside diameter of the cylindrical filling members, the area of the edge portion is adjusted and at the same time, the areas of the first confronting surface and the second confronting surface are adjusted.

Additionally, to be more precise, by adjusting the area ratio of the first confronting surface versus the second confronting surface, the thrust load being applied to the rotating shaft can be adjusted.

Normally, the pressure in the proximity of the discharge port where fluid flows out by the first impeller is higher than the pressure in the proximity of the suction port.

As a result, when the pressure pressing the first impeller toward the second impeller in the proximity of high pressure discharge port becomes smaller, the pressure in the opposite direction which presses the second impeller toward the first impeller becomes larger.

Therefore, in the sealless pump in accordance with the present invention, the first side-plate in the proximity of the discharge port has the first confronting surface and the first side-plate in the proximity of the suction port has the second confronting surface, thereby changing the area ratio of the first confronting surface versus the second confronting surface.

As a result, the thrust load being applied to the rotating shaft is adjusted. In this embodiment, the load from the first impeller to the second impeller is reduced, while the load from the second impeller toward the first impeller is increased.

In consequence, the thrust load being generated when the first impeller transmits liquid being pumped to the discharge port (the load from the first impeller to the second impeller) can be reduced.

Additionally, in the sealless pump in accordance with the present invention, it is preferable to flow the fluid flowing to non-contact type bearings being provided to the rotating shaft by a force being generated by rotation of the second impeller in the direction from the second impeller to the first impeller.

To be more precise, a bypass flow pathway which connects the inside and the outside of the motor casing of the motor unit housing the rotating shaft is provided to the motor casing on the side of the first impeller.

As mentioned hereinabove, the thrust load being generated when the first impeller transmits liquid being pumped to the discharge port becomes a load from the first impeller to the second impeller.

Consequently, by providing a bypass flow pathway to the motor casing on the side of the first impeller, fluid flowing to non-contact type bearings being provided to the rotating shaft is made to flow in an opposite direction, from the second impeller to the first impeller.

When the fluid flows as mentioned hereinabove, the load (the hydrostatic thrust load) being attributed to the fluid is oriented in an opposite direction to the thrust load which is generated when the first impeller transmits liquid being pumped to the discharge port. As a result, the thrust load can be reduced.

Additionally, in the sealless pump in accordance with the present invention, supercritical fluid or liquid of low viscosity is made to circulate as the fluid being pumped.

Moreover, the sealless pump in accordance with the present invention can be described in more details as follows.

For example, the sealless pump in accordance with the present invention is a sealless pump which is constructed in a manner that a manifold unit being equipped with a suction port and a discharge port is connected to a driving unit housing a rotating shaft (for example, a motor unit).

Then, the rotating shaft is supported by non-contact type bearings which support without contacting the rotating shaft itself, wherein an impeller is provided to the shaft end portion on the side of the manifold unit of the rotating shaft.

Furthermore, the manifold unit utilizes a force being generated by rotation of the impeller, wherein fluid being pumped is sucked in through the suction port and discharged through the discharge port.

In the meantime, in the driving unit, by transmitting fluid into the non-contact type bearings by utilizing a force being generated by the rotating shaft, the non-contact type bearings utilize the fluid being transmitted, thereby supporting the rotating shaft.

Additionally, it can be said that the driving unit utilizes the force of the driving portion which can rotate the rotating shaft for the non-contact type bearings in order to support the rotating shaft.

Then, the embodiments of the present invention that have been described above are effective to a sealless pump (for example, a canned motor pump).

There have been described herein what are to be considered preferred embodiments of the present invention. Therefore, the present invention is not limited to the above-mentioned embodiments but modifications and variations of the invention are possible to be practiced, provided all such modifications fall within the spirit and scope of the invention as mentioned as claims attached hereto.

What is claimed is:

1. A sealless pump comprising:

a manifold unit being provided with a suction port and a discharge port, and a motor unit housing a rotating shaft, wherein the rotating shaft is supported by non-contact type bearings which provide support without contacting the rotating shaft, a first impeller being installed to one end of the rotating shaft and a second impeller being installed to other end of the rotating shaft, fluid being pumped is sucked in through the suction port and discharged through the discharge port by utilizing a force being generated by rotation of the first impeller, the non-contact type bearings support the rotating shaft, by utilizing a force being generated by rotation of the second impeller so as to transmit fluid for lubrication to the non-contact type bearings, the first impeller has first blade portions installed in a radial direction with respect to an axis of the first impeller, and outside and inside shrouds installed on the first blade portions, the outside shroud has a first confronting surface which communicates with the discharge port and a second confronting surface which communicates with the suction port, the first confronting surface and the second confronting surface facing the same direction, the fluid at the discharge port applies pressure to the first confronting surface and the fluid at the suction port applies pressure to the second confronting surface, and the area of the first confronting surface is smaller than the area of the second confronting surface.

2. The sealless pump as described in claim 1, wherein the non-contact type bearings are installed so as to have first gaps with the rotating shaft therebetween, and the second impeller forms a fluid film in the first gaps between the non-contact type bearings and the rotating shaft by transmitting the fluid for lubrication to the non-contact type bearings with the force being generated by rotation.

3. The sealless pump as described in claim 1, wherein the non-contact type bearings are cylindrical journal bearings which surround the rotating shaft, wherein depressed areas serving as first gaps are formed on inner circumference surfaces of the journal bearings, the second impeller forms fluid films inside the depressed areas by transmitting the fluid for lubrication to inside of the depressed areas, and the fluid films being formed support the rotating shaft with static pressure of the fluid for lubrication.

4. The sealless pump as described in claim 1, wherein, by providing a first flow pathway which connects the suction port and the discharge port, a circulation flow pathway for the fluid being pumped where the fluid being pumped circulates between the suction port and the discharge port is formed, and by connecting a second flow pathway, where the fluid for lubrication being transmitted by the second impeller flows to the non-contact type bearings, and a third flow pathway, where the fluid reaching the non-contact type bearings flows to the second impeller, a circulation flow pathway for bearings where the fluid for lubrication circulates between the second impeller and the non-contact bearings is formed.

5. The sealless pump as described in claim 4, wherein the circulation flow pathway for bearings has a heat exchanger provided.

6. The sealless pump as described in claim 1, wherein the other end of the rotating shaft is provided with a thrust bearing supporting load acting on the rotating shaft in a thrust direction through the second impeller, and the second impeller, by transmitting fluid being generated by rotation to the thrust bearing, forms a fluid film between the thrust bearing and the second impeller.

7. The sealless pump as described in claim 6, wherein the second impeller has second blade portions installed in a radial direction with respect to an axis of the second impeller, and has second side-plates installed so as to hold rotating surfaces of the second blade portions, the second side-plates are held by the thrust bearing and provided so as to have second gaps between the side-plates and the thrust bearing, and the second impeller, by transmitting the fluid for lubrication to the clearances with the force being generated by rotation, forms the fluid films between the second side-plates and the thrust bearing.

8. The sealless pump as described in claim 7, wherein depressed areas serving the second gaps between the second side-plates and the thrust bearing are formed on holding surfaces of the thrust bearing, the second impeller, by transmitting the fluid for lubrication to inside of the depressed areas, forms fluid films inside depressed areas, and the fluid films being formed support the second impeller with static pressure of the fluid for lubrication.

9. The sealless pump as described in claim 7, wherein the second side-plates of the second impeller are vertical plane surfaces with respect to the axis of the second impeller.

10. The sealless pump as described in claim 1, further comprising:

a cylindrical filling member which has an end portion facing the first confronting surface, and which prevents liquid being pumped from leaking from the discharge port to the suction port are provided so as to surround the first side-plates and to be located close to a space between the first side-plates and an inner wall of a manifold casing of the manifold unit.

11. The sealless pump as described in claim 1, wherein by rotating of the second impeller, fluid flowing to the non-contact type bearings which are installed to the rotating shaft flows from the first impeller to the second impeller.

12. The sealless pump as described in claim 11, wherein, a bypass flow pathway which goes through continuously inside and outside of a motor casing of the motor unit housing the rotating shaft is installed to the motor casing on a side of the second impeller.

13. The sealless pump as described in claim 1, wherein supercritical fluid or liquid circulates as the fluid being pumped.

* * * * *